US011039242B2

(12) United States Patent
Janse et al.

(10) Patent No.: US 11,039,242 B2
(45) Date of Patent: Jun. 15, 2021

(54) AUDIO CAPTURE USING BEAMFORMING

(71) Applicant: KONINKLIJKE PHILIPS N.V., Eindhoven (NL)

(72) Inventors: Cornelis Pieter Janse, Eindhoven (NL); Rik Jozef Martinus Janssen, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 168 days.

(21) Appl. No.: 16/474,715

(22) PCT Filed: Jan. 2, 2018

(86) PCT No.: PCT/EP2018/050045
§ 371 (c)(1),
(2) Date: Jun. 28, 2019

(87) PCT Pub. No.: WO2018/127483
PCT Pub. Date: Jul. 12, 2018

(65) Prior Publication Data

US 2021/0136489 A1 May 6, 2021

(30) Foreign Application Priority Data

Jan. 3, 2017 (EP) ..... 17150096

(51) Int. Cl.
*H04R 3/00* (2006.01)
*G10L 21/0208* (2013.01)
(Continued)

(52) U.S. Cl.
CPC ..... *H04R 3/005* (2013.01); *G10L 21/0208* (2013.01); *G10L 25/87* (2013.01); *G10L 2021/02166* (2013.01); *H04R 2430/03* (2013.01)

(58) Field of Classification Search
None
See application file for complete search history.

(56) References Cited

U.S. PATENT DOCUMENTS 7,146,012 B1 12/2006 Belt et al.
7,602,926 B2 10/2009 Roovers
(Continued)

FOREIGN PATENT DOCUMENTS

WO 2007004188 A2 1/2007
WO 2015139938 A 9/2015
(Continued)

OTHER PUBLICATIONS

Boll "Suppression of Acoustic Noise in Speech Using Spectral Subtraction" IEEE Trans. Acoustics, Speech and Signal Processing, vol. 27, pp. 113-120 Apr. 1979.
(Continued)

*Primary Examiner* — Paul W Huber

(57) ABSTRACT

An audio capture apparatus comprises a first beamformer (303) which is arranged to generate a beamformed audio output signal. An adapter (305) adapts beamform parameters of the first beamformer and a detector (307) detects an attack of speech in the beamformed audio output signal. A controller (309) controls the adaptation of the beamform parameters to occur in a predetermined adaptation time interval determined in response to the detection of the attack of speech. The beamformer (303) may generate noise reference signal(s) and the detector (309) may be arranged to detect the attack of speech in response to a comparison of a signal level of the beamformed audio output signal relative to a signal level of the at least one noise reference signal.

15 Claims, 7 Drawing Sheets

(51) Int. Cl.
*G10L 25/87* (2013.01)
*G10L 21/0216* (2013.01)

(56) References Cited

U.S. PATENT DOCUMENTS

| | | | | |
|---|---|---|---|---|
| 8,077,892 | B2 * | 12/2011 | Dijkstra | H04R 25/30 381/315 |
| 2002/0193130 | A1 | 12/2002 | Yang et al. | |
| 2008/0232607 | A1 | 9/2008 | Tashev et al. | |
| 2012/0294118 | A1 | 11/2012 | Haulick et al. | |
| 2017/0243577 | A1 | 8/2017 | Wingate | |
| 2017/0249936 | A1 * | 8/2017 | Hayashida | G10L 15/04 |

FOREIGN PATENT DOCUMENTS

| | | | |
|---|---|---|---|
| WO | 2018127412 | A1 | 7/2018 |
| WO | 2018127450 | A1 | 7/2018 |

OTHER PUBLICATIONS

International Search Report in PCT/EP2018/050045 dated Feb. 16, 2018.

* cited by examiner

AUDIO CAPTURE USING BEAMFORMING

CROSS-REFERENCE TO PRIOR APPLICATIONS

This application is the U.S. National Phase application under 35 U.S.C. § 371 of International Application No. PCT/EP2018/050045, filed on Jan. 2, 2018, which claims the benefit of EP Patent Application No. EP 17150096.0, filed on Jan. 3, 2017. These applications are hereby incorporated by reference herein.

FIELD OF THE INVENTION

The invention relates to audio capture using beamforming and in particular.

BACKGROUND OF THE INVENTION

Capturing audio, and in particularly speech, has become increasingly important in the last decades. Indeed, capturing speech has become increasingly important for a variety of applications including telecommunication, teleconferencing, gaming, audio user interfaces, etc. However, a problem in many scenarios and applications is that the desired speech source is typically not the only audio source in the environment. Rather, in typical audio environments there are many other audio/noise sources which are being captured by the microphone. One of the critical problems facing many speech capturing applications is that of how to best extract speech in a noisy environment. In order to address this problem a number of different approaches for noise suppression have been proposed.

Indeed, research in e.g. hands-free speech communications systems is a topic that has received much interest for decades. The first commercial systems available focused on professional (video) conferencing systems in environments with low background noise and low reverberation time. A particularly advantageous approach for identifying and extracting desired audio sources, such as e.g. a desired speaker, was found to be the use of beamforming based on signals from a microphone array. Initially, microphone arrays were often used with a focused fixed beam but later the use of adaptive beams became more popular.

In the late 1990's, hands-free systems for mobiles started to be introduced. These were intended to be used in many different environments, including reverberant rooms and at high(er) background noise levels. Such audio environments provide substantially more difficult challenges, and in particular may complicate or degrade the adaptation of the formed beam.

Initially, research in audio capture for such environments focused on echo cancellation, and later on noise suppression. An example of an audio capture system based on beamforming is illustrated in FIG. 1. In the example, an array of a plurality of microphones 101 are coupled to a beamformer 103 which generates an audio source signal z(n) and one or more noise reference signal(s) x(n).

The microphone array 101 may in some embodiments comprise only two microphones but will typically comprise a higher number.

The beamformer 103 may specifically be an adaptive beamformer in which one beam can be directed towards the speech source using a suitable adaptation algorithm.

For example, U.S. Pat. Nos. 7,146,012 and 7,602,926 discloses examples of adaptive beamformers that focus on the speech but also provides a reference signal that contains (almost) no speech.

The beamformer creates an enhanced output signal, z(n), by adding the desired part of the microphone signals coherently by filtering the received signals in forward matching filters and adding the filtered outputs. Also, the output signal is filtered in backward adaptive filters having conjugate filter responses to the forward filters (in the frequency domain corresponding to time inversed impulse responses in the time domain). Error signals are generated as the difference between the input signals and the outputs of the backward adaptive filters, and the coefficients of the filters are adapted to minimize the error signals thereby resulting in the audio beam being steered towards the dominant signal. The generated error signals x(n) can be considered as noise reference signals which are particularly suitable for performing additional noise reduction on the enhanced output signal z(n).

The primary signal z(n) and the reference signal x(n) are typically both contaminated by noise. In case the noise in the two signals is coherent (for example when there is an interfering point noise source), an adaptive filter 105 can be used to reduce the coherent noise.

For this purpose, the noise reference signal x(n) is coupled to the input of the adaptive filter 105 with the output being subtracted from the audio source signal z(n) to generate a compensated signal r(n). The adaptive filter 105 is adapted to minimize the power of the compensated signal r(n), typically when the desired audio source is not active (e.g. when there is no speech) and this results in the suppression of coherent noise.

The compensated signal is fed to a post-processor 107 which performs noise reduction on the compensated signal r(n) based on the noise reference signal x(n). Specifically, the post-processor 107 transforms the compensated signal r(n) and the noise reference signal x(n) to the frequency domain using a short-time Fourier transform. It then, for each frequency bin, modifies the amplitude of $R(\omega)$ by subtracting a scaled version of the amplitude spectrum of $X(\omega)$. The resulting complex spectrum is transformed back to the time domain to yield the output signal q(n) in which noise has been suppressed. This technique of spectral subtraction was first described in S. F. Boll, "Suppression of Acoustic Noise in Speech using Spectral Subtraction," IEEE Trans. Acoustics, Speech and Signal Processing, vol. 27, pp. 113-120, April 1979.

A specific example of noise suppression based on relative energies of the audio source signal and the noise reference signal in individual time frequency tiles is described in WO2015139938A.

In many audio capture systems, a plurality of beamformers which independently can adapt to audio sources may be applied. For example, in order to track two different speakers in an audio environment, an audio capturing apparatus may include two independently adaptive beamformers.

Indeed, although the system of FIG. 1 provides very efficient operation and advantageous performance in many scenarios, it is not optimum in all scenarios. Indeed, whereas many conventional systems, including the example of FIG. 1, provide very good performance when the desired audio source/speaker is within the reverberation radius of the microphone array, i.e. for applications where the direct energy of the desired audio source is (preferably significantly) stronger than the energy of the reflections of the desired audio source, it tends to provide less optimum results when this is not the case. In typical environments, it has been found that a speaker typically should be within 1-1.5 meter of the microphone array.

However, there is a strong desire for audio based hands-free solutions, applications, and systems where the user may be at further distances from the microphone array. This is for example desired both for many communication and for many voice control systems and applications. Systems providing speech enhancement including de-reverberation and noise suppression for such situations are in the field referred to as super hands-free systems.

In more detail, when dealing with additional diffuse noise and a desired speaker outside the reverberation radius the following problems may occur:

The beamformer may often have problems distinguishing between echoes of the desired speech and diffuse background noise, resulting in speech distortion.

The adaptive beamformer may converge slower towards the desired speaker. During the time when the adaptive beam has not yet converged, there will be speech leakage in the reference signal, resulting in speech distortion in case this reference signal is used for non-stationary noise suppression and cancellation. The problem increases when there are more desired sources that talk after each other.

A solution to deal with slower converging adaptive filters (due to the background noise) is to supplement this with a number of fixed beams being aimed in different directions as illustrated in FIG. 2. However, this approach is particularly developed for scenarios wherein a desired audio source is present within the reverberation radius. It may be less efficient for audio sources outside the reverberation radius and may often lead to non-robust solutions in such cases, especially if there is also acoustic diffuse background noise.

A particularly critical element of the capture of audio using beamformers is the adaptation of the beamformers/beams. Various beamforming adaptation algorithms have been proposed. For example, for a speech capture application, an adaptation algorithm may seek to adapt the beamform filters based on a criterion of maximizing the output signal level during periods of speech.

However, the current adaptation algorithms tend to be based on assuming a benign environment in which the audio source to which the beamformer is adapting is the dominant audio source providing a relatively high signal to noise ratio. Indeed, most algorithms tend to assume that the direct path (and possibly the early reflections) dominate both the later reflections, the reverberation tail, and indeed noise from other sources (including diffuse background noise).

As a consequence, such adaptation approaches tend to be suboptimal in environments where these assumptions are not met, and indeed tend to provide suboptimal performance for many real-life applications.

Indeed, audio capture in general for sources outside the reverberation radius tends to be difficult due to the energy of the direct field from the source to the device being small in comparison to the energy of the reflected speech and the acoustic background noise. Although multi-beam systems may improve audio capture in such scenarios, the capture will be degraded, or indeed often simply not work, if the adaptation is not reliable.

Current adaptation algorithms tend to be suboptimal and provide relatively poor adaptation for scenarios in which the desired audio source is dominated by late reflections, reverberations, and/or noise, including in particular diffuse noise. Such scenarios may typically occur when the desired audio source is far from the microphone array.

Thus, in many practical applications, the performance of beamforming audio capture systems may be degraded or limited by the adaptation performance.

Hence, an improved beamforming audio capture approach would be advantageous, and in particular an approach providing an improved adaptation would be advantageous. In particular, an approach allowing reduced complexity, increased flexibility, facilitated implementation, reduced cost, improved audio capture, improved suitability for capturing audio outside the reverberation radius, reduced noise sensitivity, improved speech capture, improved beamform adaptation, improved control, and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided an audio capture apparatus comprising: a first beamformer arranged to generate a beamformed audio output signal; an adapter for adapting beamform parameters of the first beamformer; a detector for detecting an attack of speech in the beamformed audio output signal; and a controller for controlling the adaptation of the beamform parameters to occur in a predetermined adaptation time interval determined in response to the detection of the attack of speech.

The invention may provide improved audio capture in many embodiments. In particular, improved performance in reverberant environments and/or for audio sources at larger distances may often be achieved. The approach may in particular provide improved speech capture in many challenging audio environments. In many embodiments, the approach may provide reliable and accurate beamforming. The approach may provide an audio capture apparatus having reduced sensitivity to e.g. noise, reverberation, and reflections. In particular, improved capture of speech sources outside the reverberation radius can often be achieved.

The approach may provide improved speech capture for speech sources experiencing room responses with dominant late reflections or reverberations. The approach may improve adaptation and audio capture for speech sources which experience room responses that cannot be fully modelled by impulse responses of limited durations. In particular, improved performance may be achieved in many embodiments by the adaptation being directed towards the direct path and early reflection components while disregarding the late reflections (that are not modelled by the beamform filters).

In particular, an improved performance may often be provided in scenarios wherein the direct path from an audio source to which the beamformers adapt is not dominant. Improved performance for scenarios comprising a high degree of diffuse noise, reverberant signals and/or late reflections can often be achieved. Improved performance for point audio sources at further distances, and particularly outside the reverberation radius, can often be achieved.

The approach may automatically control the adapter to adapt the beamform parameters to adaptation time intervals in which advantageous characteristics exist for adapting the beamformer. In particular, it may automatically control the system to adapt the beamform parameters during times where the speech signal will result in such advantageous scenarios, and specifically the adaptation may be performed during adaptation time intervals in which the desired signal components from the speech source dominate the undesired/interfering signal components.

Indeed, the approach may control the adaptation to be during adaptation time intervals in which the dominating signal components (specifically early reflections) are predominantly those that the beamform filters of the beamformer can model while not adapting during time intervals in which the undesired signal components (late reflections/reverberation/diffuse noise that cannot be modelled by the beamform filters) from the speech source dominate. Indeed, often when a speech attack is detected, the received signal components from the speech source will be dominated by strong early reflections while the signal components from late reflections/reverberations currently received will have originated from earlier and weaker speech sections. In many embodiments and scenarios, the detection of an attack of speech will indicate a scenario where the received signal components from a given speech source is made up of early reflections from the stronger signal during the attack, and of late reflections and reverberation from the weaker signal prior to the attack. This scenario may exist for a given duration until the late reflections are also originating from the strong speech during or after the attack, at which time the adaptation time interval is typically terminated (or may already be terminated). Thus, adaptation may automatically be performed during times when the early reflections (including the direct path) are dominant and thus the adaptation will seek to adapt to the early reflections and not to late reflections, even if the acoustic room response has much stronger components for the later reflections.

The approach may accordingly provide substantially improved performance in scenarios wherein late reflections and reverberation are significant for the given speech source. In particular, improved performance is achieved for speech sources outside the reverberation radius. The approach may at the same time allow efficient adaptation as it may be performed throughout a speech segment whenever advantageous situations occur. Thus, adaptation is not limited to the start of speech but may be performed throughout speech whenever an attack occurs.

The attack of speech may specifically be an onset of speech after a period of silence. However, in many embodiments and scenarios, the attack of speech may occur during a period of speech.

An attack of speech may be an increase of the source speech level when compared with an average speech level of a previous period. The previous period may typically be in the range from 60 to 100 msec. The increase of the source speech level may typically be a sudden increase, and may often be a substantial increase.

A speech of attack may in some embodiments be considered to occur when a signal level of early reflections dominate a signal level of late reverberations and/or reverberant diffuse noise.

The audio capturing apparatus may in many embodiments comprise an output unit for generating an audio output signal in response to the beamformed audio output signal.

The beamformer may be a filter-and-combine beamformer. The filter-and-combine beamformer may comprise a beamform filter for each microphone and a combiner for combining the outputs of the beamform filters to generate the beamformed audio output signal. The filter-and-combine beamformer may specifically comprise beamform filters in the form of Finite Response Filters (FIRs) having a plurality of coefficients.

In most embodiments, each of the beamform filters has a time domain impulse response which is not a simple Dirac pulse (corresponding to a simple delay and thus a gain and phase offset in the frequency domain) but rather has an impulse response which typically extends over a time interval of no less than 2, 5, 10 or even 30 msec.

The predetermined adaptation time interval may have a predetermined duration, and in many embodiments may have a predetermined maximum duration. The predetermined (maximum) duration may in many embodiments not be less than 5 msec, 10 msec, 20 msec, 50 msec, or 100 msec. The predetermined (maximum) duration may in many embodiments not exceed 50 msec, 100 msec, 200 msec, 500 msec, or 1 s.

In accordance with an optional feature of the invention, the detector is arranged to detect the attack of speech in response to a signal level of received early reflections relative to a signal level of received late reflections.

This may provide a particularly advantageous approach for detecting speech attack suitable for controlling the adaptation. In particular, it may provide particularly advantageous adaptation by directing this towards the direct path and early reflections that can effectively be modelled by the beamform filters of the beamformer. The early reflections may include the first reflection (which typically is considered the zero'th reflection).

An attack of speech may specifically be detected and considered to occur when the signal components received from a speech source by early reflections (including the direct path) dominate the signal components received in late reflections and/or reverberant/diffuse noise. The signal components from the early reflections (including the direct path) may be considered to dominate when the signal energy of these are higher (or in some cases 3 dB, 6 dB or even 10 dB higher) than the signal energy of the signal components received in late reflections and/or reverberant/diffuse noise. In some embodiments, the early reflections may be considered to be reflections received with a delay from the direct path which does not exceed a duration of impulse responses of the beamform filters of the beamform filter. Later reflections (including reverberation and diffuse noise) from the speech source may be those which are received with a higher delay than the duration of the impulse responses. In some embodiments, the early reflections may e.g. be considered to be reflections which are received with a delay relative to the direct path below a given (possibly predetermined) threshold. The remaining signal components may be considered late reflections or reverberations. In different embodiments, different approaches or consideration may be used to differentiate between early (including direct path) and late reflections (including the reverberation/diffuse noise).

In accordance with an optional feature of the invention, the first beamformer is arranged to generate at least one noise reference signal; and the detector is arranged to detect the attack of speech in response to a comparison of a signal level of the beamformed audio output signal relative to a signal level of the at least one noise reference signal.

This may provide a particularly advantageous approach for detecting speech attack suitable for controlling the adaptation. In particular, it may provide particularly advantageous adaptation by directing this towards the direct path and early reflections that can effectively be modelled by the beamform filters of the beamformer. The early reflections may include the first reflection (which typically is considered the zero'th reflection).

The approach may specifically allow a speech attack estimate to be generated in response to the signal level of the beamformed audio output signal relative to the signal level of the noise reference signal. For example, it may be determined as a ratio between these.

Such a measure may automatically provide a strong indicating of when the received speech at the microphone array is predominantly characterized by signal components that can be modelled by the beamform filters (early reflections) and when it is predominantly characterized by signal components that cannot be modelled by the beamform filters. The adaptation may accordingly be focused on scenarios in which the adaptation will focus on signal components that can be modelled. This may provide substantially improved speech capture for speech sources e.g. outside the reverberation radius.

A speech attack estimate based on a comparison of the beamformed audio output signal and noise reference may provide a good indication of both the start of speech attack and of the end of speech attack. It may particularly be highly suitable for identifying scenarios during a speech attack where the received signal is dominated by early reflections and may indicate when this scenario is being replaced by a scenario wherein late reflections dominate.

In some embodiments, the controller may be arranged to determine a begin time of the predetermined adaptation time interval in response to a comparison of a signal level of the beamformed audio output signal relative to a signal level of the at least one noise reference signal.

This may further improve performance, and may specifically in many embodiments provide an improved adaptation performance. It may provide a desirable detection of the beginning of a situation in which the received signals are dominated by early reflections (within the duration of the impulse response of the beamform filters).

The begin time may specifically be determined in response to a difference measure between the signal level of the beamformed audio output signal and the signal level of the noise reference signal increase above a threshold.

In accordance with an optional feature of the invention, the controller is arranged to terminate the predetermined adaptation time interval in response to a comparison of a signal level of the beamformed audio output signal relative to a signal level of the at least one noise reference signal.

This may further improve performance, and may specifically in many embodiments provide an improved adaptation performance. It may provide a desirable detection of the end of a situation in which the received signals are dominated by early reflections (within the duration of the impulse response of the beamform filters).

The controller may be arranged to terminate the adaptation time interval prior to a predetermined end time in response to the comparison of the signal level of the beamformed audio output signal relative to the signal level of the at least one noise reference signal. In some embodiments, the adaptation time interval may have as adaptation time interval with a predetermined maximum duration. However, if the comparison indicates that early reflections may not be dominant, the controller may proceed to terminate the adaptation time interval (and thus the adaptation) prior to the predetermined maximum duration.

The time for terminating the predetermined adaptive time interval may specifically be determined in response to a difference measure between the signal level of the beamformed audio output signal and the signal level of the noise reference signal fall below a threshold.

The controller may be arranged to terminate the adaptation time interval prior to a predetermined duration in response to the comparison.

In accordance with an optional feature of the invention, the first beamformer is arranged to generate at least one noise reference signal, and the detector comprises: a first transformer for generating a first frequency domain signal from a frequency transform of the beamformed audio output signal, the first frequency domain signal being represented by time frequency tile values; a second transformer for generating a second frequency domain signal from a frequency transform of the at least one noise reference signal, the second frequency domain signal being represented by time frequency tile values; a difference processor arranged to generate a time frequency tile difference measure being indicative of a difference between a first monotonic function of a norm of a time frequency tile value of the first frequency domain signal and a second monotonic function of a norm of a time frequency tile value of the second frequency domain signal; and a speech attack estimator for generating a speech attack estimate in response to a combined difference value for time frequency tile difference measures for frequencies above a frequency threshold.

This may in many scenarios and applications provide a particularly advantageous speech capture. The speech attack estimate determined in this way has been found to provide a very advantageous and high performance indication of suitable times for adapting the beamformer. Improved performance for scenarios comprising a high degree of diffuse noise, reverberant signals and/or late reflections can specifically be achieved. Improved speech capture for sources at further distances, and particularly outside the reverberation radius, can often be achieved.

The speech attack estimate may automatically provide a strong indicating of when the received speech at the microphone array is predominantly characterized by signal components that can be modelled by the beamform filters (early reflections) and when it is predominantly characterized by signal components that cannot be modelled by the beamform filters. The adaptation may accordingly be focused on scenarios in which the adaptation will focus on signal components that can be modelled. This may provide substantially improved speech capture for speech sources e.g. outside the reverberation radius.

The first and second monotonic functions may typically both be monotonically increasing functions, but may in some embodiments both be monotonically decreasing functions.

The norms may typically be L1 or L2 norms, i.e. specifically the norms may correspond to a magnitude or power measure for the time frequency tile values.

A time frequency tile may specifically correspond to one bin of the frequency transform in one time segment/frame. Specifically, the first and second transformers may use block processing to transform consecutive segments of the first and second signal. A time frequency tile may correspond to a set of transform bins (typically one) in one segment/frame.

In many embodiments, the frequency threshold is not below 500 Hz. This may further improve performance, and may e.g. in many embodiments and scenarios ensure that a sufficient or improved decorrelation is achieved between the beamformed audio output signal values and the noise reference signal values used in determining the point audio source estimate. In some embodiments, the frequency threshold is advantageously not below 1 kHz, 1.5 kHz, 2 kHz, 3 kHz or even 4 kHz.

In accordance with an optional feature of the invention, the detector is arranged to determine a start time for the predetermined adaptation time interval in response to the combined difference value increasing above a threshold.

This may further improve performance, and may specifically in many embodiments provide an improved adaptation performance. It may provide a desirable detection of both the end and the start of a situation in which the received signals are dominated by early reflections (within the duration of the impulse response of the beamform filters).

In accordance with an optional feature of the invention, the detector is arranged to determine terminate the adaptation time interval in response to the combined difference value falling below a threshold.

This may further improve performance, and may specifically in many embodiments provide an improved adaptation performance. It may provide a desirable detection of the end of a situation in which the received signals are dominated by early reflections (within the duration of the impulse response of the beamform filters).

In accordance with an optional feature of the invention, the detector is arranged to generate a noise coherence estimate indicative of a correlation between an amplitude of the beamformed audio output signal and an amplitude of the at least one noise reference signal; and at least one of the first monotonic function and the second monotonic function is dependent on the noise coherence estimate.

This may further improve performance, and may specifically in many embodiments in particular provide improved performance for microphone arrays with smaller inter-microphone distances.

The noise coherence estimate may specifically be an estimate of the correlation between the amplitudes of the beamformed audio output signal and the amplitudes of the noise reference signal when there is no point audio source active (e.g. during time periods with no speech, i.e. when the speech source is inactive). The noise coherence estimate may in some embodiments be determined based on the beamformed audio output signal and the noise reference signal, and/or the first and second frequency domain signals. In some embodiments, the noise coherence estimate may be generated based on a separate calibration or measurement process.

In accordance with an optional feature of the invention, the adapter is arranged to modify an adaptation rate for beamform parameters for a first time frequency tile in response to a time frequency tile difference measure for the first time frequency tile.

This may further improve performance, and may specifically in many embodiments provide an improved adaptation performance In accordance with an optional feature of the invention, the detector is arranged to filter at least one of the norms of the time frequency tile values of the first frequency domain signal and the norm of the time frequency tile values of the second frequency domain signal; the filtering including time frequency tiles differing in both time and frequency.

This may provide an improved speech attack estimate in many embodiments. The filtering may be a low pass filtering, such as e.g. an averaging.

In accordance with an optional feature of the invention, a duration from the attack of speech to an end of the predetermined adaptation time interval does not exceed 100 msec.

This may provide advantageous performance in many embodiments. In some embodiments, the predetermined adaptation time interval does not exceed 10, 15, 20, 30, 50, 150, 250 or 500 msec.

In accordance with an optional feature of the invention, the audio capturing apparatus further comprises a plurality of beamformers including the first beamformer; and the detector is arranged to generate a speech attack estimate for each beamformer of the plurality of beamformers; and the audio capturing apparatus further comprises an adapter for adapting at least one of the plurality of beamformers in response to the speech attack estimates.

This may further improve performance, and may specifically in many embodiments provide an improved adaptation performance for systems utilizing a plurality of beamformers. In particular, it may allow the overall performance of the system to provide both accurate and reliable adaptation to the current audio scenario while at the same time providing quick adaptation to changes in this (e.g. when a new audio source emerges).

In accordance with an optional feature of the invention, the plurality of beamformers comprises a first beamformer arranged to generate a beamformed audio output signal and at least one noise reference signal; and a plurality of constrained beamformers coupled to the microphone array and each arranged to generate a constrained beamformed audio output and at least one constrained noise reference signal; and wherein the adapter is arranged to adapt constrained beamform parameters for a first constrained beamformer subject to a criteria comprising at least one constraint from the group of: a speech attack estimate for the first constrained beamformer is indicative of speech attack being detected for the first constrained beamformer; and a speech attack estimate for the first constrained beamformer is indicative of higher probability of speech attack than the speech attack estimate for any other constrained beamformer of the plurality of constrained beamformers.

The invention may provide improved audio capture in many embodiments. In particular, improved performance in reverberant environments and/or for audio sources may often be achieved. The approach may in particular provide improved speech capture in many challenging audio environments. In many embodiments, the approach may provide reliable and accurate beam forming while at the same time providing fast adaptation to new desired audio sources. The approach may provide an audio capturing apparatus having reduced sensitivity to e.g. noise, reverberation, and reflections. In particular, improved capture of audio sources outside the reverberation radius can often be achieved.

In some embodiments, an output audio signal from the audio capturing apparatus may be generated in response to the first beamformed audio output and/or the constrained beamformed audio output. In some embodiments, the output audio signal may be generated as a combination of the constrained beamformed audio output, and specifically a selection combining selecting e.g. a single constrained beamformed audio output may be used.

Adaptation of the beamformers may be by adapting filter parameters of the beamform filters of the beamformers, such as specifically by adapting filter coefficients. The adaptation may seek to optimize (maximize or minimize) a given adaptation parameter, such as e.g. maximizing an output signal level when an audio source is detected or minimizing it when only noise is detected. The adaptation may seek to modify the beamform filters to optimize a measured parameter.

In accordance with an optional feature of the invention, the audio capturing apparatus further comprises: a beam difference processor for determining a difference measure for at least one of the plurality of constrained beamformers, the difference measure being indicative of a difference between beams formed by the first beamformer and the at least one of the plurality of constrained beamformers; and wherein the adapter is arranged to adapt constrained beamform parameters with a constraint that constrained beamform parameters are adapted only for constrained beamformers of the plurality of constrained beamformers for which a difference measure has been determined that meets a similarity criterion.

This may provide improved performance in many embodiments.

The difference measure may reflect the difference between the formed beams of the first beamformer and of the constrained beamformer for which the difference measure is generated, e.g. measured as a difference between directions of the beams. In many embodiments, the difference measure may be indicative of a difference between the beamformed audio outputs from the first beamformer and the constrained beamformer. In some embodiments, the difference measure may be indicative of a difference between the beamform filters of the first beamformer and of the constrained beamformer. The difference measure may be a distance measure, such as e.g. a measure determined as the distance between vectors of the coefficients of the beamform filters of the first beamformer and the constrained beamformer.

It will be appreciated that a similarity measure may be equivalent to a difference measure in that a similarity measure by providing information relating to the similarity between two features inherently also provides information relating the difference between these, and vice versa.

The similarity criterion may for example comprise a requirement that the difference measure is indicative of a difference being below a given measure, e.g. it may be required that a difference measure having increasing values for increasing difference is below a threshold.

According to an aspect of the invention there is provided a method of audio capture comprising: a beamformer generating a beamformed audio output signal; adapting beamform parameters of the beamformer; detecting an attack of speech in the beamformed audio output signal; controlling the adaptation of the beamform parameters to occur in an adaptation time interval determined in response to the detection of the attack of speech.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to a speech capturing audio system based on beamforming but it will be appreciated that the approach is applicable to many other systems and scenarios for audio capturing.

Figure 3:
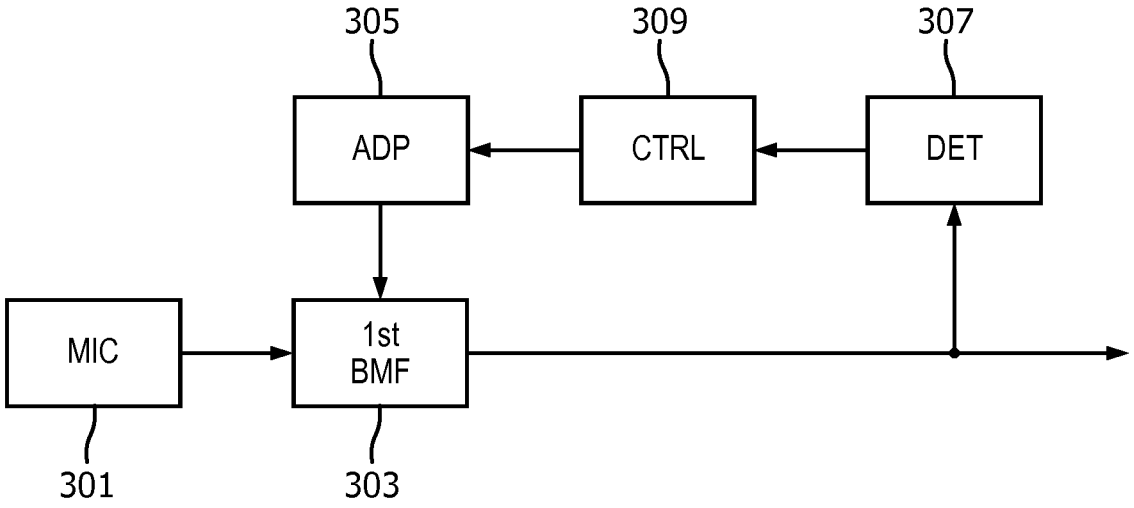
FIG. 3 illustrates an example of elements of an audio capturing apparatus in accordance with some embodiments of the invention.

FIG. 3 illustrates an example of some elements of an audio capturing apparatus in accordance with some embodiments of the invention.

The audio capturing apparatus comprises a microphone array 301 which comprises a plurality of microphones arranged to capture audio in the environment.

The microphone array 301 is coupled to a beamformer 303 (typically either directly or via an echo canceller, amplifiers, digital to analog converters etc. as will be well known to the person skilled in the art).

The beamformer 303 is arranged to combine the signals from the microphone array 301 such that an effective directional audio sensitivity of the microphone array 301 is generated. The beamformer 303 thus generates an output signal, referred to as the beamformed audio output or beamformed audio output signal, which corresponds to a selective capturing of audio in the environment. The beamformer 303 is an adaptive beamformer and the directivity can be controlled by setting parameters, referred to as beamform parameters, of the beamform operation of the beamformer 303, and specifically by setting filter parameters (typically coefficients) of beamform filters.

The beamformer 303 is accordingly an adaptive beamformer where the directivity can be controlled by adapting the parameters of the beamform operation.

The beamformer 303 is specifically a filter-and-combine (or specifically in most embodiments a filter-and-sum) beamformer. A beamform filter may be applied to each of the microphone signals and the filtered outputs may be combined, typically by simply being added together.

Figure 4:
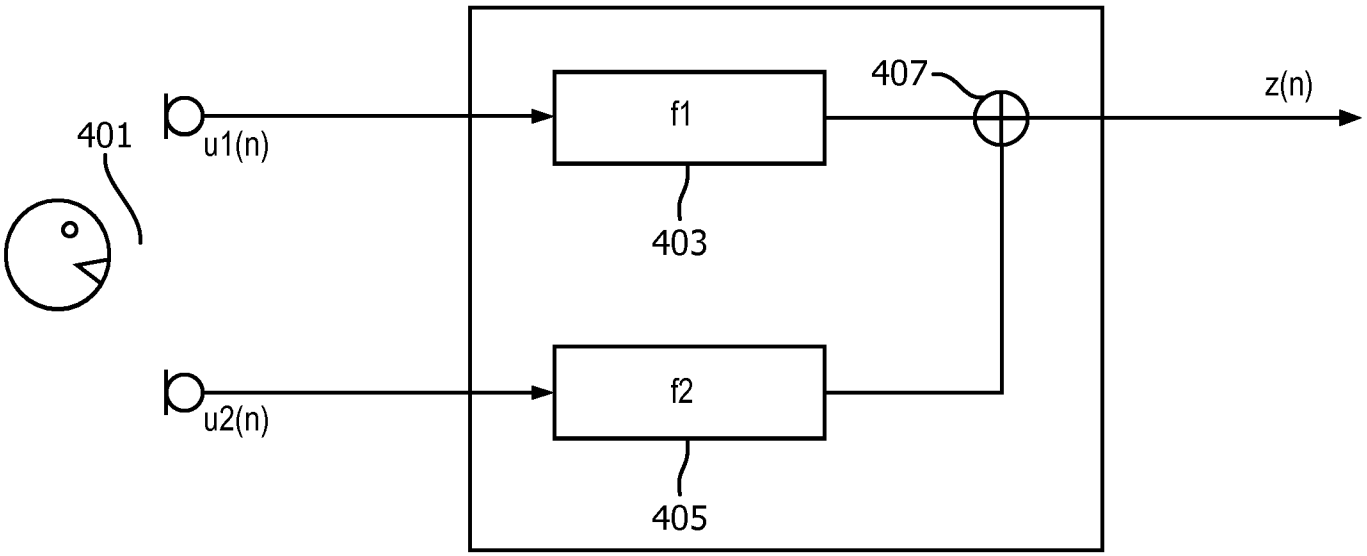
FIG. 4 illustrates an example of elements of a filter-and-sum beamformer.

FIG. 4 illustrates a simplified example of a filter-and-sum beamformer based on a microphone array comprising only two microphones 401. In the example, each microphone are coupled to a beamform filter 403, 405 the outputs of which are summed in summer 407 to generate a beamformed audio output signal. The beamform filters 403, 405 have impulse responses f1 and f2 which are adapted to form a beam in a given direction. It will be appreciated that typically the microphone array will comprise more than two microphones and that the principle of FIG. 4 is easily extended to more microphones by further including a beamform filter for each microphone.

The beamformer 303 may include such a filter-and-sum architecture for beamforming (as e.g. in the beamformers of U.S. Pat. Nos. 7,146,012 and 7,602,926). It will be appreciated that in many embodiments, the microphone array 301 may however comprise more than two microphones. Further, it will be appreciated that the beamformer 303 include functionality for adapting the beamform filters as previously described. Also, in the specific example, the beamformer 303 generates not only a beamformed audio output signal but also a noise reference signal.

In most embodiments, each of the beamform filters has a time domain impulse response which is not a simple Dirac pulse (corresponding to a simple delay and thus a gain and phase offset in the frequency domain) but rather has an impulse response which typically extends over a time interval of no less than 2, 5, 10 or even 30 msec.

The impulse response may often be implemented by the beamform filters being FIR (Finite Impulse Response) filters with a plurality of coefficients. The beamformer 303 may in such embodiments adapt the beamforming by adapting the filter coefficients. In many embodiments, the FIR filters may have coefficients corresponding to fixed time offsets (typically sample time offsets) with the adaptation being achieved by adapting the coefficient values. In other embodiments, the beamform filters may typically have substantially fewer coefficients (e.g. only two or three) but with the timing of these (also) being adaptable.

A particular advantage of the beamform filters having extended impulse responses rather than being a simple variable delay (or simple frequency domain gain/phase adjustment) is that it allows the beamformer 303 to not only adapt to the strongest, typically direct, signal component. Rather, it allows the beamformer 303 to adapt to include further signal paths corresponding typically to reflections. Accordingly, the approach allows for improved performance in most real environments, and specifically allows improved performance in reflecting and/or reverberating environments and/or for audio sources further from the microphone array 301.

A very critical element of the performance of an adaptive beamformer is the adaptation of the directionality (generally referred to as the beam although it will be appreciated that the extended impulse responses results in this directivity having not only a spatial component but also a temporal component, i.e. the beam formed as a temporal variation for reflections etc.).

In the system of FIG. 3, the beamformer 303 comprises and an adapter 305 which is arranged to adapt the beamform parameters of the first beamformer. Specifically, it is arranged to adapt the coefficients of the beamform filters to provide a given (spatial and temporal) beam.

It will be appreciated that different adaptation algorithms may be used in different embodiments and that various optimization parameters will be known to the skilled person. For example, the adapter 305 may adapt the beamform parameters to maximize the output signal value of the beamformer 303. As a specific example, consider a beamformer where the received microphone signals are filtered with forward matching filters and where the filtered outputs are added. The output signal is filtered by backward adaptive filters, having conjugate filter responses to the forward filters (in the frequency domain corresponding to time inversed impulse responses in the time domain. Error signals are generated as the difference between the input signals and the outputs of the backward adaptive filters, and the coefficients of the filters are adapted to minimize the error signals thereby resulting in the maximum output power. This can further inherently generate a noise reference signal from the error signal. Further details of such an approach can be found in U.S. Pat. Nos. 7,146,012 and 7,602,926.

It is noted that approaches such as that of U.S. Pat. Nos. 7,146,012 and 7,602,926 are based on the adaptation being based both on the audio source signal z(n) and the noise reference signal(s) x(n) from the beamformers, and it will be appreciated that the same approach may be used for the beamformer of FIG. 3.

Figure 1:
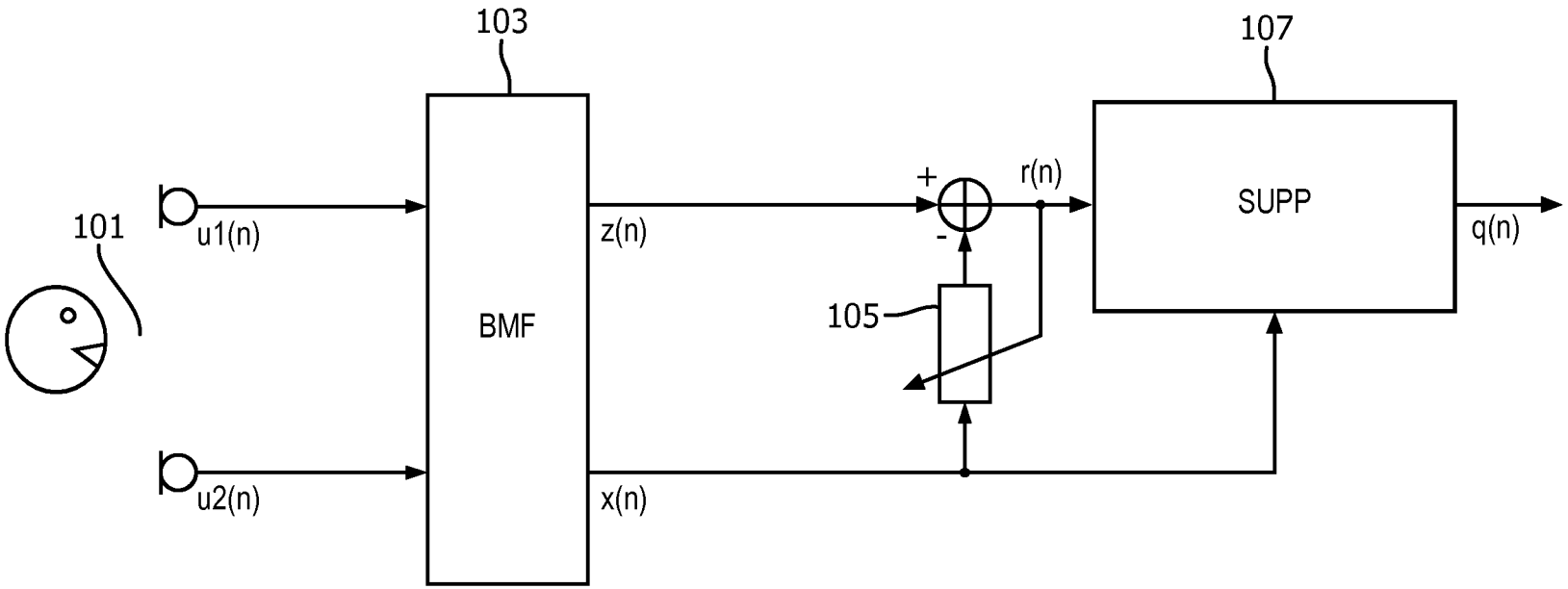
FIG. 1 illustrates an example of elements of a beamforming audio capturing system.
Figure 2:
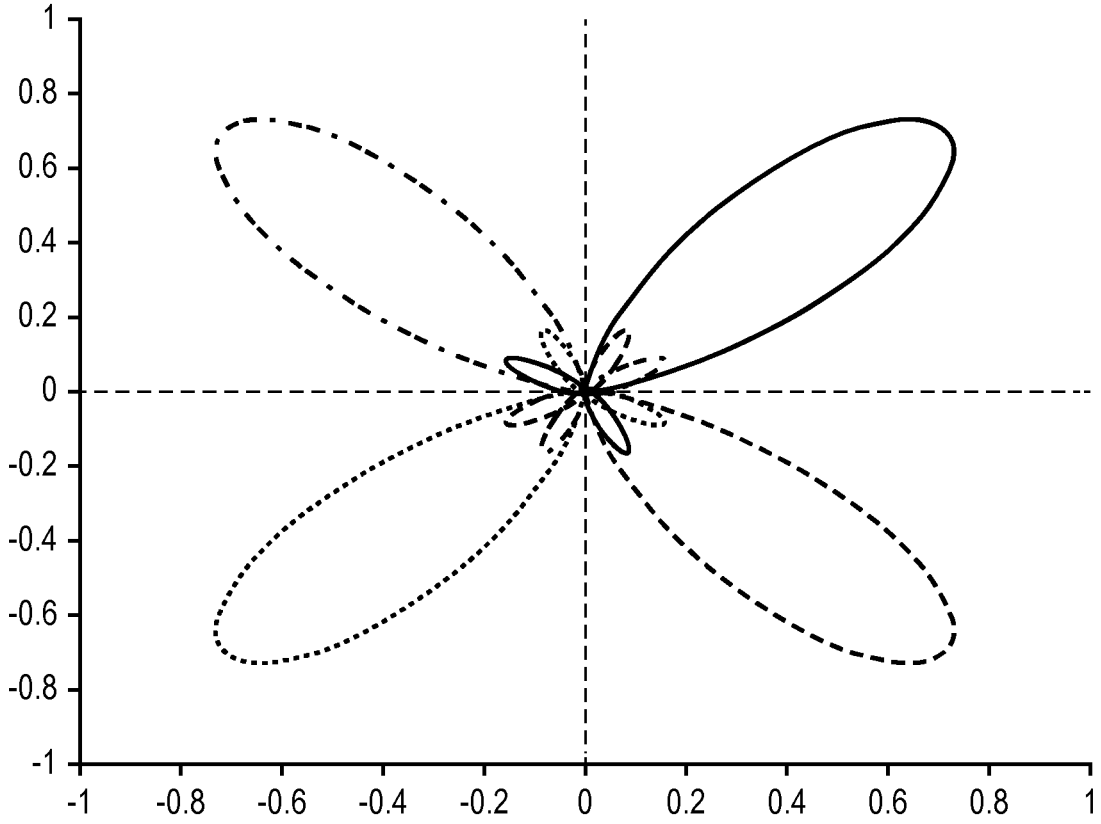
FIG. 2 illustrates an example of a plurality of beams formed by an audio capturing system.

Indeed, the beamformer 303 may specifically be a beamformer corresponding to the one illustrated in FIG. 1 and disclosed in U.S. Pat. Nos. 7,146,012 and 7,602,926.

The beamformer 303 is arranged to generate both a beamformed audio output signal and a noise reference signal.

The beamformer 303 may be arranged to adapt the beamforming to capture a desired audio source and represent this in the beamformed audio output signal. It may further generate the noise reference signal to provide an estimate of a remaining captured audio, i.e. it is indicative of the noise that would be captured in the absence of the desired audio source. In the example in embodiments where the beamformer 303 is a beamformer as disclosed in U.S. Pat. Nos. 7,146,012 and 7,602,926, the noise reference may be generated as previously described, e.g. by directly using the error signal. However, it will be appreciated that other approaches may be used in other embodiments. For example, in some embodiments, the noise reference may be generated as the microphone signal from an (e.g. omnidirectional) microphone minus the generated beamformed audio output signal, or even the microphone signal itself in case this noise reference microphone is far away from the other microphones and does not contain the desired speech. As another example, the beamformer 303 may be arranged to generate a second beam having a null in the direction of the maximum of the beam generating the beamformed audio output signal, and the noise reference may be generated as the audio captured by this complementary beam.

In some embodiments, post-processing such as the noise suppression of FIG. 1 may by the output processor 305 be applied to the output of the audio capturing apparatus. This may improve performance for e.g. voice communication. In such post-processing, non-linear operations may be included although it may e.g. for some speech recognizers be more advantageous to limit the processing to only include linear processing.

The adaptation performance is critical for the performance of a beamforming audio capture system. However, whereas typical conventional approaches perform well in theoretical and ideal audio environments, they tend to be much less efficient and accurate in many practical scenarios.

Indeed, the adaptation tends to degrade for increasing noise and specifically if adaptation is performed when the active source is not present, the adaptation will during this time interval adapt to the noise rather than the desired audio source. In order to address this, systems have been developed where the adaptation is only performed when the audio source is present. Specifically, for a speech capture system, systems have been developed which detects the presence of speech and only adapts during periods of speech.

However, whereas this approach may address the problem of adaptation when the desired audio source is not active, it does not address any of the potential issues during the times in which the desired audio source is active.

Indeed, as realized by the Inventors, the characteristics of the acoustic environment may significantly impact the adaptation and overall performance, especially when extended impulse response filters are used which seek to estimate larger intervals of the room impulse response. In particular, the Inventors have realized that in scenarios in which the direct path is not dominant, the adaptation may often be suboptimal. Indeed, in scenarios where the audio source is outside the reverberation radius, the received signal tends to be dominated by later reflections and reverberation. This complicates and degrades adaptation and indeed may in many scenarios even prevent adaptation to the correct audio source even when this is active.

The system of FIG. 3 includes an adaptation control which may in many scenarios provide improved adaptation performance resulting in improved speech capture.

The audio capture apparatus specifically includes a detector 307 which is arranged to detect the attack of speech in the beamformed audio output signal.

An attack of speech may be a sudden increase of the speech level when compared with the average speech level of the previous period. A speech sentence consists of a sequence of phonemes, where each phoneme has a certain strength or sound pressure and has an average length between 60 and 100 msec. The differences in the strengths of the phonemes can be quite large. Vowels, and in particular extended vowels can have relative strong levels. A stop consonant can be 20 dB to 30 dB lower than the preceding vowel.

The beginning of such a vowel can be considered as a speech attack when the level is e.g. 4 dB, 10 dB or even 20 dB stronger than the level of the preceding phoneme.

Thus, an increase in the level of speech (from the speech source, i.e. an increase of the source speech level) relative to an average speech level of a previous period is known as an attack of speech The previous period may typically be in the range from 60 to 100 msec. The increase of the source speech level may typically be a sudden increase, and may often be a substantial increase. For example, an increase by e.g. at least 3 dB, 4 dB, 10 dB or more of the speech level within a period of no more than e.g. 5 msec, 10 msec or 20 msec, can be considered to be an attack of speech.

A speech of attack may in some embodiments be considered to occur when a signal level of early reflections dominate a signal level of late reverberations and/or reverberant diffuse noise.

The detector 307 may specifically in some scenarios detect speech onset, i.e. a specific example of a speech attack (attack of speech) may be the onset of speech. The detector 307 may accordingly be arranged to detect when a period of speech starts after a period of silence (in which no speech content is detected on the beamformed audio output signal).

The detector 307 is coupled to a controller 309 which is coupled to the adapter 305 and the detector 307 and which is arranged to control the adaptation of the beamform parameters such that the adaptation occurs in an adaptation time interval which is determined from the detection of the attack of speech. Thus, an adaptation time interval is determined in response to the detection of the beginning of a speech segment. The adaptation time interval may specifically start when the attack of speech is detected (henceforth also referred to as the speech attack detection) and e.g. have a predetermined duration.

Thus, the controller 309 is arranged to start an adaptation of the beamformer 303 and significantly is also arranged to stop the adaptation. Thus, the controller 309 is arranged to stop the adaptation of the beamformer 303 even if the speech segment extends beyond the duration of the adaptation time interval. Thus, the controller 309 is arranged to end the adaptation time interval during a speech segment. The controller 309 is thus arranged to control the adaptation to specifically occur in a typically relatively short time interval at the start of a new speech segment. In many embodiments, adaptation may only occur during such adaptation time intervals.

In the examples described, the adaptation time interval is a predetermined adaptation time interval which has a predetermined duration or a predetermined maximum duration. Accordingly, the adaptation time interval will have a predetermined maximum duration and the adaptation will accordingly be terminated after this predetermined maximum duration. In some embodiments, the controller may additionally be arranged to terminate the adaptation time interval prior to the predetermined maximum duration, e.g. if conditions that are not suitable for adaptation are detected (specifically if it is detected that early reflections are not dominant).

In contrast to conventional approaches where adaptation is performed continuously (or continuously when a desired speech source is active), the controller 309 restricts the adaptation to be performed in an initial interval of a speech segment. The approach may specifically control the adaptation such that it is performed during a time period wherein the specific characteristics of the speech attack can be utilized in adapting the beamformer 303. It may specifically focus the adaptation on an initial interval wherein the direct path or early reflections are more significant relative to the later reflections and reverberations than it will be during later time intervals of the speech segment. The Inventors have not only realized this effect but also found that it provides for a substantially improved adaptation for a beamforming speech capture system, and in particular for a system where the acoustic room responses are modelled by impulse responses have a substantial duration which however is not sufficient to include all possible reflections.

The approach will be elucidated further by first describing the effect realized by the Inventors for a scenario wherein the beamformer is continuously adapted whenever speech is active.

The beamform filters of a beamformer will be adapted to try to emulate the acoustic room response from the audio source to the corresponding microphone. If the desired source is outside the reverberation radius, the energy in the sound field caused by the direct field and first reflections is relatively low in comparison to the energy caused by the rest of the reflections (including reverberation). Accordingly, when the beamformer is continuously adapted during a speech segment the adaptation may typically be to the later reflections as this results in a larger overall captured speech energy. Thus, rather than adapt to the direct path and the first reflections, the adaptation may typically be to later reflections.

Figure 5:
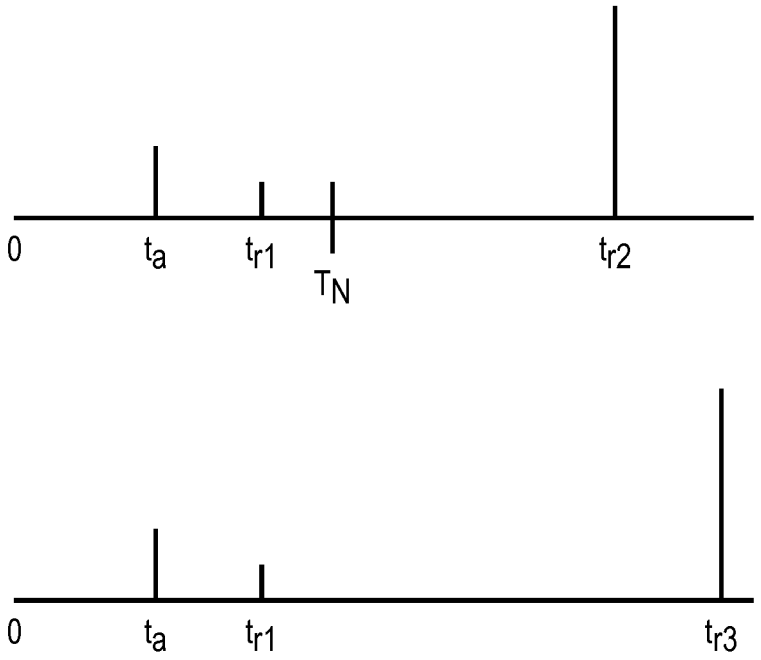
FIGS. 5-7 illustrate examples of received acoustic reflections from a speech source.

This can be illustrated by considering two simplified room responses from a speaker to two different microphones as illustrated in FIG. 5.

In the example, the room responses comprise direct field/path contributions that arrive at the microphones at the same time $t_d$. Further, the first reflections arrive at the microphones ($t_{r1}$) at the same time. Further, very strong reflections arrive at the microphones at different times $t_{r2}$ and $t_o$. If it is in such a scenario considered that the beamform filters have a filter length of the adaptive filter equal to $T_N$, then it is desired that the adaptive filter models the time around the first reflection, i.e. it is desired for the impulse response to reflect the time between $\tau_s$ and $\tau_s+T_N$, where $\tau_s=t_d-\Delta$ and $\Delta$ is selected sufficiently large to be able to deal with direct field contributions that do not arrive at the same time at the microphones.

However, in such a scenario, the adaptation will typically adapt the impulse responses of the beamform filters to be determined mainly by the strong reflections, and therefore they will adapt to model the delay ($t_{r3}-t_{r2}$).

Figure 6:
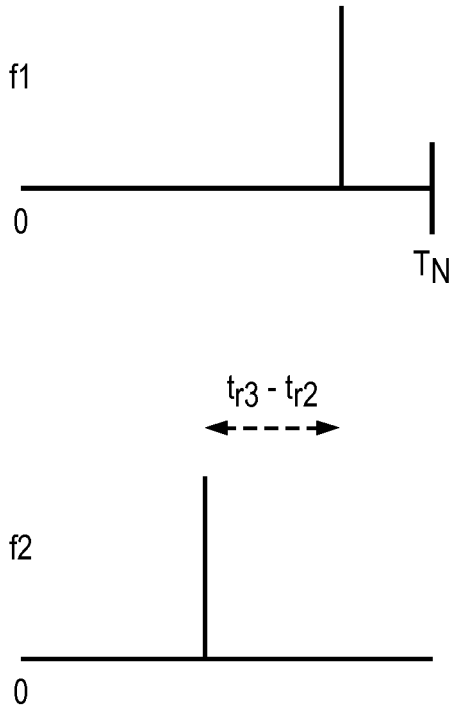
Figure 7:
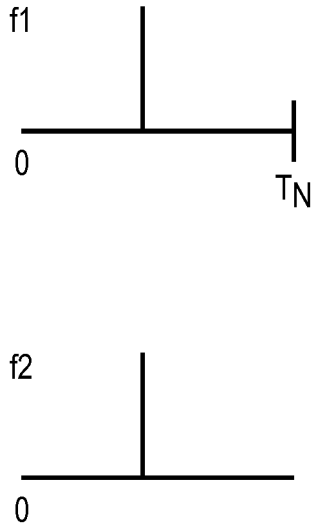

This can be understood from considering the two microphone example of FIG. 4 where beamformed output signal z is obtained by filtering the microphone signals in forward matching filters and adding the filtered outputs. The forward matching filters are obtained in the adaptation process in which, under a power constraint on the filter coefficients, the output power of z is maximized. This will result in the impulse responses of the beamform filters being adapted to look like those illustrated in FIG. 6 whereas the desired result would be those of FIG. 7. Thus, rather than the desired result where the simultaneous responses will result in the direct paths and the first reflections adding coherently after filtering, the adapted filters of FIG. 6 will result in these being attenuated.

In the approach of the system of FIG. 3, however, the attack of speech is detected, and specifically the arrival of the first signals from the direct path may be detected. At this time, the adaptation time interval may be initialized, i.e. the beamformer 303 may start to adapt. Thus, the adapter 305 may by the controller 309 be controlled to start adaptation at time $t=t_d$ in FIG. 5. It may then proceed to update the beamformer (specifically maximizing the output power) during the adaptation time interval which may have a duration of $T_N$, where $T_N$ may be predetermined or have a predetermined maximum value, and thus the adaptation will only be adapted based on signals received within this duration. If this duration is kept sufficiently short, the adaptation will not include the time at which the large late reflections arrive and thus the adaptation can be based on the weaker earlier reflections (and direct path). This will in the specific example allow the beamform filters to be adapted to have the desired impulse responses of FIG. 7.

The approach is accordingly based on an insight that improved adaptation is achieved when the adaptation of the beamformer is during attacks of speech and not during decays as this allows the system to model a weak direct path and first reflections.

Equivalently, for an attack of speech, the signal level increases typically very fast and by a large amount. This results in a time in which the direct path and (other) early reflections received at the microphone array have originated from a high level speech signal whereas the signal components currently received via late reflections, or as reverberation/diffuse noise, originated prior to the attack, and thus correspond to low signal levels. This may result in the early reflections dominating the received signal even if the room response exhibits stronger late reflections/reverberation than early reflections. Thus, the system may detect this situation and specifically adapt the beamformer when this occurs.

The approach accordingly extends the consideration or desire to separate the desired audio source from noise from other audio sources when adapting and further may introduce a differentiation between different signal components received from the desired audio source, and specifically between the earlier signal components and the later signal components. Thus, in the approach, the diffuse sound part may indeed also originate from the desired source and thus even in a situation with no background noise or other audio sources, the approach provides an improved adaptation over typical conventional system which simply adapts whenever speech is present. The approach allows for improved adaptation even when the direct path and early reflection components are much weaker than later reflections, and indeed the system is arranged to limit the adaptation to attacks of speech where the direct path/early reflections may still dominate due to the later reflections not having had sufficient time to reach the microphone array.

It will be appreciated that different approaches for detecting the attack of speech may be used in different embodiments. Indeed, in some embodiments where the speech signal is dominant with respect to other audio sources, including diffuse background noise, the detector 307 may simply be a level detector which detects when the signal level increases above a threshold (e.g. set low enough to detect the arrival of the first direct path).

However, in most embodiments, there may be significant late reflections and/or noise and more complex detections may advantageously be applied.

For example, in some embodiments, the detector 307 may be arranged to directly detect the attack of speech in response to a signal level of received early reflections relative to a signal level of received late reflections. Indeed, during the initial part of a speech attack the early reflections may dominate the late reflections whereas during the speech segment itself the late reflections may be dominant.

This effect may not only be exploited in the adaptation focusing on times when the early reflections dominate but may also in some embodiments be directly used to detect the attack of speech.

As an example, the detector 307, may determine the envelope of the beamformed audio signal, followed by high pass filtering of that envelope signal. Attacks in the speech causes the envelope to rise sharply, whereas late reverberation cause the envelope to decay slowly according to an exponential that is determined by the reverberation time. High pass filtering removes the decay parts of the envelope signal and the attacks remain. If the high pass filtered envelope signal exceeds a threshold and exceeds the late reverberations, then this can be considered to correspond to a detection of an attack of speech.

As another example, two low pass filters may filter the received (speech) signal with one having a lower cut-off frequency than the other (and thus "averaging" over a longer duration). If an attack of speech occurs, the signal level of speech may suddenly increase substantially. This increase will result in a faster increase in the output level for the higher frequency cut-off filter than for the lower frequency cut-off filter. Effectively, the higher frequency cut-off filter may in this case represent post attack signal, and thus the early reflections for the attack, whereas the lower frequency cut-off filter may still reflect the pre-attack total signal, which may be dominated by late reflections.

Accordingly, an attack of speech may be detected by comparing the filter outputs and indicating a speech attack when the output of the higher frequency cut-off filter exceeds the output of the lower frequency cut-off filter by a given amount.

Thus, by evaluating signals that represent early and late reflections (or the combination of the early and late reflections, i.e. the total signal), particularly advantageous situations for adaptation can be detected. These may not only be detected at speech onset following a period of silence but may also be determined during normal continuous speech. Indeed, they can be detected such that it is possible to adapt whenever direct and early reflections dominate the received speech signal. When new parts of speech are much louder than previous parts, the direct and early reflections may dominate the weaker parts of the later reflections from the previous parts. This is detected and the adaptation is then performed resulting in an improved adaptation to the desired sections of the room response, namely the early response.

In the example of FIG. 3, the beamformer 303 is arranged to generate both a beamformed audio output signal and one or more noise reference signals. In such embodiments, the detector 307 may be arranged to detect the attack of speech in response to a comparison of a signal level (and specifically a power) indication for the beamformed audio output signal relative to a signal level (and specifically a power) indication for the at least one noise reference signal. Thus, the signal level of the beamformed audio output signal may be compared to the signal level of the noise reference signal and the attack of speech detection may be based on this comparison. For example, if the signal level of the beamformed audio output signal exceeds the signal level of the noise reference signal by a given margin, this may be considered to correspond to a detection of an attack of speech.

Indeed, after a period of silence (or constant speech level if the late reflections/reverberation dominate), the audio captured in the direction of the beam and the audio captured in other directions will typically be fairly similar (possibly after a compensation for the width of the beam). For example, if diffuse noise is spatially uniformly distributed, the only difference in the signal levels will be due to the beam being narrow and this may accordingly be compensated for.

However, if the beam is already focused on the desired speech source (i.e. some adaptation have already been performed), the attack of speech will result in the corresponding increased signal level being captured by the beamformer 303 and the signal level of the beamformed audio output signal will increase. Further, as the beamform filters are adapted to the direct path and early reflections, and these during an initial attack are all that are received from the attack, much of the energy received from the speech source will be captured and therefore the signal level of the beamformed audio output signal will increase while the signal level of the noise reference signal will remain constant. Thus, the signal level of the beamformed audio output signal relative to the signal level of the noise reference signal will increase substantially and this can be detected as an attack of speech.

Further, after a certain delay, the late reflections from the attack will arrive at the microphone array. However, if these arrive with a delay that is longer than the duration of the impulse responses of the beamform filters (i.e. they are reflections of the room response with a delay that exceeds the duration of the impulse responses of the beamform filters), they will not be coherently combined into the beamformed audio output signal but as a consequence also be contributing to the noise reference signal. Thus, the signal level of the beamformed audio output signal will no longer be higher than the signal level of the noise reference signal (assuming that the later reflections are stronger) and as a result the detector 307 will no longer detect an attack of speech.

Thus, such a detector 307 can specifically detect the attack of speech as opposed to merely the presence of speech. Further, this can continuously be done during a speech segment, and indeed the approach may allow the automated detection of any attack of speech resulting in the early reflections dominating the late reflections. This may provide a very advantageous approach.

Indeed, in some embodiments, both the beginning and the end of the adaptation time interval may be determined in response to the detector 307 output. Specifically, the adaptation time interval may be initiated when the detector 307 indicates that speech attack has been detected (e.g. difference in signal levels exceed a threshold) and last until the detector 307 does not detect the attack of speech (e.g. the difference in the signal levels no longer exceed the threshold). In some embodiments, the end of the adaptation time interval may be determined to occur after a predetermined duration. In other embodiments, the end time may be determined either after a predetermined maximum duration or the adaptation time interval may be determined to be prior to this if specific conditions are detected.

In the following a specific and particularly advantageous approach for the detection of the attack of speech will be described. The approach is based on the approach of comparing the beamformed audio output signal with the noise reference signal but will be based on comparisons in individual time frequency tiles. The approach has been found to provide a detection which is very robust and provides very advantageous performance in many practical scenarios, including in particular scenarios in which the audio source is outside the reverberation radius and where substantial noise is present.

Figure 8:
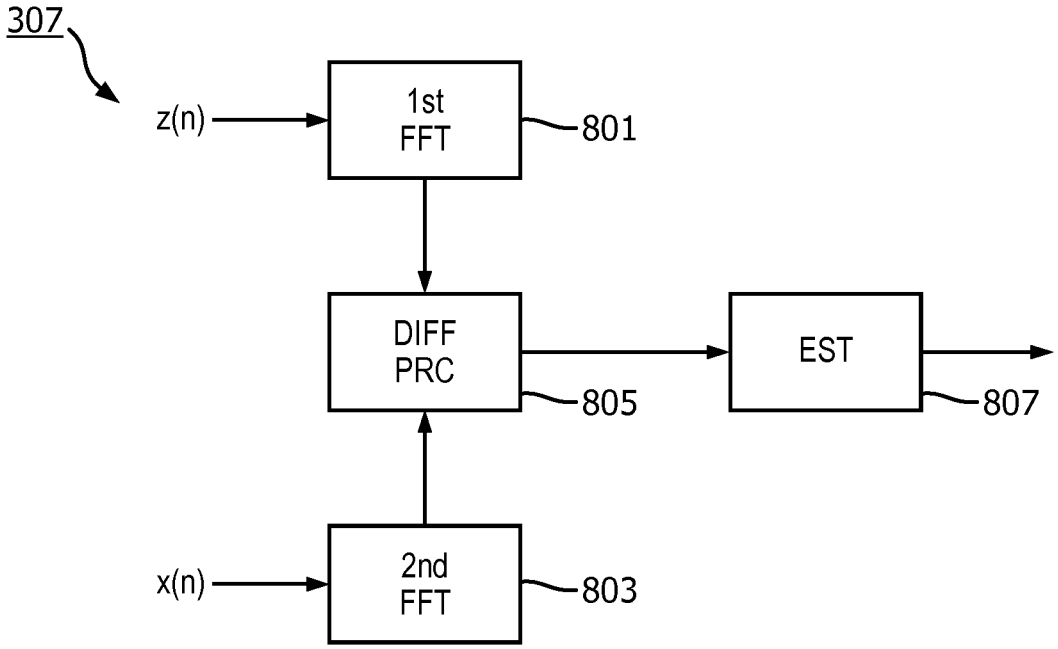
FIG. 8 illustrates an example of elements of a speech attack estimator for an audio capturing apparatus in accordance with some embodiments of the invention.

In the approach, the detector 307 of FIG. 3 comprises elements as shown in FIG. 8. Specifically, the detector 307 comprises a detector 307 which is arranged to generate a speech attack estimate indicative of whether an attack of speech is occurring or not. The detector 307 determines this estimate based on the beamformed audio output signal and the noise reference signal generated by the beamformer 303.

The detector 307 comprises a first transformer 801 arranged to generate a first frequency domain signal by applying a frequency transform to the beamformed audio output signal. Specifically, the beamformed audio output signal is divided into time segments/intervals. Each time segment/interval comprises a group of samples which are transformed, e.g. by an FFT, into a group of frequency domain samples. Thus, the first frequency domain signal is represented by frequency domain samples where each frequency domain sample corresponds to a specific time interval (the corresponding processing frame) and a specific frequency interval. Each such frequency interval and time interval is typically in the field known as a time frequency tile. Thus, the first frequency domain signal is represented by a value for each of a plurality of time frequency tiles, i.e. by time frequency tile values.

The detector 307 further comprises a second transformer 803 which receives the noise reference signal. The second transformer 803 is arranged to generate a second frequency domain signal by applying a frequency transform to the noise reference signal. Specifically, the noise reference signal is divided into time segments/intervals. Each time segment/interval comprises a group of samples which are transformed, e.g. by an FFT, into a group of frequency domain samples. Thus, the second frequency domain signal is represented a value for each of a plurality of time frequency tiles, i.e. by time frequency tile values.

Figure 9:
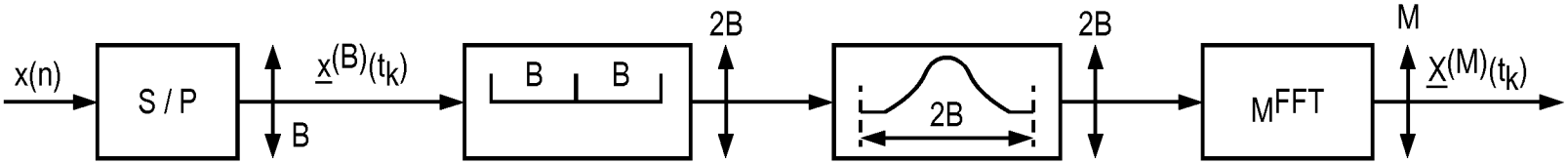
FIG. 9 illustrates an example of elements of frequency domain transformer for a speech attack estimator for an audio capturing apparatus in accordance with some embodiments of the invention.

FIG. 9 illustrates a specific example of functional elements of possible implementations of the first and second transform units 801, 803. In the example, a serial to parallel converter generates overlapping blocks (frames) of 2B samples which are then Hanning windowed and converted to the frequency domain by a Fast Fourier Transform (FFT).

The beamformed audio output signal and the noise reference signal are in the following referred to as z(n) and x(n) respectively and the first and second frequency domain signals are referred to by the vectors $\underline{Z}^{(M)}(t_k)$ and $\underline{X}^{(M)}(t_k)$ (each vector comprising all M frequency tile values for a given processing/transform time segment/frame).

In many embodiments, the beamformer 303 may as in the example of FIG. 1 comprise an adaptive filter which attenuates or removes the noise in the beamformed audio output signal which is correlated with the noise reference signal.

Following the transformation to the frequency domain, the real and imaginary components of the time frequency values are assumed to be Gaussian distributed. This assumption is typically accurate e.g. for scenarios with noise originating from diffuse sound fields, for sensor noise, and for a number of other noise sources experienced in many practical scenarios.

The first transformer 801 and the second transformer 803 are coupled to a difference processor 805 which is arranged to generate a time frequency tile difference measure for the individual tile frequencies. Specifically, it can for the current frame for each frequency bin resulting from the FFTs generate a difference measure. The difference measure is generated from the corresponding time frequency tile values of the beamformed audio output signal and the noise reference signals, i.e. of the first and second frequency domain signals.

In particular, the difference measure for a given time frequency tile is generated to reflect a difference between a first monotonic function of a norm of the time frequency tile value of the first frequency domain signal (i.e. of the beamformed audio output signal) and a second monotonic function of a norm of the time frequency tile value of the second frequency domain signal (the noise reference signal). The first and second monotonic functions may be the same or may be different.

The norms may typically be an L1 norm or an L2 norm. This, in most embodiments, the time frequency tile difference measure may be determined as a difference indication reflecting a difference between a monotonic function of a magnitude or power of the value of the first frequency domain signal and a monotonic function of a magnitude or power of the value of the second frequency domain signal.

The monotonic functions may typically both be monotonically increasing but may in some embodiments both be monotonically decreasing.

It will be appreciated that different difference measures may be used in different embodiments. For example, in some embodiments, the difference measure may simply be determined by subtracting the results of the first and second functions from each other. In other embodiments, they may be divided by each other to generate a ratio indicative of the difference etc.

The difference processor 805 accordingly generates a time frequency tile difference measure for each time frequency tile with the difference measure being indicative of the relative level of respectively the beamformed audio output signal and the noise reference signal at that frequency.

The difference processor 805 is coupled to a speech attack estimator 807 which generates the speech attack estimate in response to a combined difference value for time frequency tile difference measures for frequencies above a frequency threshold. Thus, the speech attack estimator 807 generates the speech attack estimate by combining the frequency tile difference measures for frequencies over a given frequency. The combination may specifically be a summation, or e.g. a weighted combination which includes a frequency dependent weighting, of all time frequency tile difference measures over a given threshold frequency.

The speech attack estimate is thus generated to reflect the relative frequency specific difference between the levels of the beamformed audio output signal and the noise reference signal over a given frequency. The threshold frequency may typically be above 500 Hz.

The inventors have realized that such a measure provides a strong indication of whether speech attack occurs or not. Indeed, they have realized that the frequency specific comparison, together with the restriction to higher frequencies, in practice provides an improved indication of the presence of speech attack. Further, they have realized that the estimate is suitable for application in acoustic environments and scenarios where conventional approaches do not provide accurate results. Specifically, the described approach may provide advantageous and accurate detection of speech attack even for non-dominant speech sources that are far from the microphone array 301 (and outside the reverberation radius) and in the presence of strong diffuse noise.

In many embodiments, the speech attack estimator 807 may be arranged to generate the speech attack estimate to simply indicate whether speech attack has been detected or not. Specifically, the speech attack estimator 807 may be arranged to indicate that the speech attack has been detected of the combined difference value exceeds a threshold. Thus, if the generated combined difference value indicates that the difference is higher than a given threshold, then it is considered that speech attack has been detected in the beamformed audio output signal. If the combined difference value is below the threshold, then it is considered that a speech attack has not been detected in the beamformed audio output signal.

The described approach may thus provide a low complexity detection of speech attack or attack. In particular, it is noted that the speech attack estimate may exhibit the previously described characteristics, namely that during silent or constant signal level periods, the estimate will be low; during times of an attack when early reflections but not late reflections of the attack are received, the estimate will be high; and following the attack when strong late reflections of the attack (which are outside the impulse response interval) are received, the estimate will be low. Thus, the approach allows for the speech attack estimate to directly indicate that speech attack is occurring rather than merely detecting the presence of speech. The specific approach has further been found to provide very efficient performance in practice, and indeed has been found to provide advantageous detection for speech sources outside the reverberation interval and in the presence of strong noise resulting from late reflections and reverberations.

In the following, a specific example of a highly advantageous determination of a speech attack estimate will be described.

In the example, the beamformer 303 may as previously described adapt to focus on a desired speech source. It may provide a beamformed audio output signal which is focused on the source, as well as a noise reference signal that is indicative of the late reverberations and possibly audio from other sources. The beamformed audio output signal is denoted as z(n) and the noise reference signal as x(n). Both z(n) and x(n) may typically be contaminated with late reverberations and possibly noise, both of which can be modelled as diffuse noise.

Let $Z(t_k,\omega_l)$ be the (complex) first frequency domain signal corresponding to the beamformed audio output signal. This signal consists of the desired (direct plus first reflections) speech signal $Z_s(t_k,\omega_l)$ and the reverberated speech signal $Z_r(t_k,\omega_l)$ (which includes reverberation and late reflections that cannot be modelled by the beamform filters of the beamformer):

$$Z(t_k,\omega_l)=Z_s(t_k,\omega_l)+Z_r(t_k,\omega_l).$$

If the amplitude of $Z_r(t_k,\omega_l)$ were known, it would be possible to derive a variable d as follows:

$$d(t_k,\omega_l)=|Z(t_k,\omega_l)|-|Z_r(t_k,\omega_l).$$

which is representative of the speech amplitude $|Z_s(t_k,\omega_l)|$.

The second frequency domain signal, i.e. the frequency domain representation of the noise reference signal x(n), may be denoted by $X_n(t_k,\omega_l)$.

$z_r(n)$ and x(n) can be assumed to have equal variances as they both represent diffuse noise and are obtained by adding ($z_r$) or subtracting (x) signals with equal variances, it follows that the real and imaginary parts of $Z_r(t_k,\omega_l)$ and $X_n(t_k,\omega_l)$ also have equal variances. Therefore, $|Z_r(t_k,\omega_l)|$ can be substituted by $|X_n(t_k,\omega_l)|$ in the above equation.

In the case when no speech is present (and thus $Z(t_k,\omega_l)=Z_r(t_k,\omega_l)$), this leads to:

$$d(t_k,\omega_l)=|Z_r(t_k,\omega_l)|-|X_n(t_k,\omega_l)|,$$

where $|Z_r(t_k,\omega_l)|$ and $|X_n(t_k,\omega_l)|$ will be Rayleigh distributed, since the real and imaginary parts are Gaussian distributed and independent.

The mean of the difference of two stochastic variables equals the difference of the means, and thus the mean value of the time frequency tile difference measure above will be zero:

$$E\{d\}=0.$$

The variance of the difference of two stochastic signals equals the sum of the individual variances, and thus:

$$\mathrm{var}(d)=(4-\pi)\sigma^2.$$

Now the variance can be reduced by averaging $|Z_r(t_k,\omega_l)|$ and $|X_n(t_k,\omega_l)|$ over L independent values in the $(t_k,\omega_l)$ plane giving $$\bar{d}=\overline{|Z(t_k,\omega_l)|}-\overline{|X(t_k,\omega_l)|}.$$

Smoothing (low pass filtering) does not change the mean, so we have:

$$E\{\bar{d}\}=0.$$

The variance of the difference of two stochastic signals equals the sum of the individual variances:

$$\mathrm{var}(\bar{d})=\frac{(4-\pi)\sigma^2}{L}.$$

The averaging thus reduces the variance of the noise.

Thus, the average value of the time frequency tile difference measured when no speech is present is zero. However, in the presence of speech (direct plus first reflections), the average value will increase. Specifically, averaging over L values of the speech component will have much less effect, since all the elements of $|Z_s(t_k,\omega_l)|$ will be positive and $$E\{|Z_s(t_k,\omega_l)|\}>0.$$

Thus, when speech is present, the average value of the time frequency tile difference measure above will be above zero:

$$E\{\bar{d}\}>0.$$

The time frequency tile difference measure may be modified by applying a design parameter in the form of over-subtraction factor γ which is larger than 1:

$$\bar{d}=\overline{|Z(t_k,\omega_l)|}-\gamma\overline{|X(t_k,\omega_l)|}.$$

In this case, the mean value $E\{\bar{d}\}$ will be below zero when no (direct plus first reflections) speech is present and indeed when speech is present but late dominating reflections arrive with a delay outside the length/duration of the impulse responses of the beamform filters. However, the over-subtraction factor γ may be selected such that the mean value $E\{\bar{d}\}$ in the presence of speech attack will tend to be above zero.

In order to generate a speech attack estimate, the time frequency tile difference measures for a plurality of time frequency tiles may be combined, e.g. by a simple summation. Further, the combination may be arranged to include only time frequency tiles for frequencies above a first threshold and possibly only for time frequency tiles below a second threshold.

Specifically, the speech attack estimate may be generated as:

$$e(t_k)=\sum_{\omega_l=\omega_{low}}^{\omega_l=\omega_{high}}\bar{d}(t_k,\omega_l).$$

This speech attack estimate may be indicative of the amount of energy in the beamformed audio output signal from a desired speech source received within the window of the beamform filter impulse responses relative to the amount of energy in the noise reference signal. It may thus provide a particularly advantageous measure for distinguishing speech attack. Specifically, the attack of speech may be considered to be present if $e(t_k)$ is positive. If $e(t_k)$ is negative, it is considered that no desired speech source is found or that late reflections outside the impulse response window dominate. It will be appreciated that other thresholds than zero may be used in other embodiments.

It will be appreciated that whereas the above description exemplifies the background and benefits of the approach of the system of FIG. 3, many variations and modifications can be applied without detracting from the approach.

It will be appreciated different functions and approaches for determining the difference measure reflecting a difference between e.g. magnitudes of the beamformed audio output signal and the noise reference signal may be used in different embodiments. Indeed, using different norms or applying different functions to the norms may provide different estimates with different properties but may still result in difference measures that are indicative of the underlying differences between the beamformed audio output signal and the noise reference signal in the given time frequency tile.

Thus, whereas the previously described specific approaches may provide particularly advantageous performance in many embodiments, many other functions and approaches may be used in other embodiments depending on the specific characteristics of the application.

More generally, the difference measure may be calculated as:

$$d(t_k,\omega_l)=f_1(|Z(t_k,\omega_l)|)-f_2(|X(t_k,\omega_l)|)$$

where $f_1(x)$ and $f_2(x)$ can be selected to be any monotonic functions suiting the specific preferences and requirements of the individual embodiment. Typically, the functions $f_1(x)$ and $f_2(x)$ will be monotonically increasing or decreasing functions. It will also be appreciated that rather than merely using the magnitude, other norms (e.g. an L2 norm) may be used.

The time frequency tile difference measure is in the above example indicative of a difference between a first monotonic function $f_1(x)$ of a magnitude (or other norm) time frequency tile value of the first frequency domain signal and a second monotonic function $f_2(x)$ of a magnitude (or other norm) time frequency tile value of the second frequency domain signal. In some embodiments, the first and second monotonic functions may be different functions. However, in most embodiments, the two functions will be equal.

Furthermore, one or both of the functions $f_1(x)$ and $f_2(x)$ may be dependent on various other parameters and measures, such as for example an overall averaged power level of the microphone signals, the frequency, etc.

In many embodiments, one or both of the functions $f_1(x)$ and $f_2(x)$ may be dependent on signal values for other frequency tiles, for example by an averaging of one or more of $Z(t_k,\omega_l)$, $|Z(t_k,\omega_l)|$, $f_1(|Z(t_k,\omega_l)|)$, $X(t_k,\omega_l)$, $|X(t_k,\omega_l)|$ or $f_2(X(t_k,\omega_l)|)$ over other tiles in in the frequency and/or time dimension (i.e. averaging of values for varying indexes of k and/or l). In many embodiments, an averaging over a neighborhood extending in both the time and frequency dimensions may be performed. Specific examples based on the specific difference measure equations provided earlier will be described later but it will be appreciated that corresponding approaches may also be applied to other algorithms or functions determining the difference measure.

Examples of possible functions for determining the difference measure include for example:

$$d(t_k,\omega_l)=|Z(t_k,\omega_l)|^{\alpha}-\gamma\cdot\cdot X(t_k,\omega_l)|^{\beta}$$

where $\alpha$ and $\beta$ are design parameters with typically $\alpha=\beta$, such as e.g. in:

$$d(t_k,\omega_l)=\sqrt{|Z(t_k,\omega_l)|}-\gamma\cdot\sqrt{|X(t_k,\omega_l)|};$$

$$d(t_k,\omega_l)=\sum_{n=k-4}^{k+3}|Z(t_n,\omega_l)|-\gamma\cdot\sum_{n=k-4}^{k+3}|X(t_k,\omega_l)|$$

$$d(t_k,\omega_l)=\{|Z(t_k,\omega_l)|-\gamma\cdot|X(t_k,\omega_l)|\}\cdot\sigma(\omega_l)$$

where $\sigma(\omega_l)$ is a suitable weighting function used to provide desired spectral characteristics of the difference measure and the speech attack estimate.

It will be appreciated that these functions are merely exemplary and that many other equations and algorithms for calculating a distance measure can be envisaged.

In the above equations, the factor $\gamma$ represents a factor which is introduced to bias the difference measure towards negative values. It will be appreciated that whereas the specific examples introduce this bias by a simple scale factor applied to the noise reference signal time frequency tile, many other approaches are possible.

Indeed, any suitable way of arranging the first and second functions $f_1(x)$ and $f_2(x)$ in order to provide a bias towards negative values may be used. The bias is specifically, as in the previous examples, a bias that will generate expected values of the difference measure which are negative if there is no speech or if speech is received mainly by (too) late reflections. Indeed, if both the beamformed audio output signal and noise reference signal contain only random noise (e.g. the sample values may be symmetrically and randomly distributed around a mean value), the expected value of the difference measure will be negative rather than zero. In the previous specific example, this was achieved by the over-subtraction factor $\gamma$ which resulted in negative values when there is no speech attack.

Figure 10:
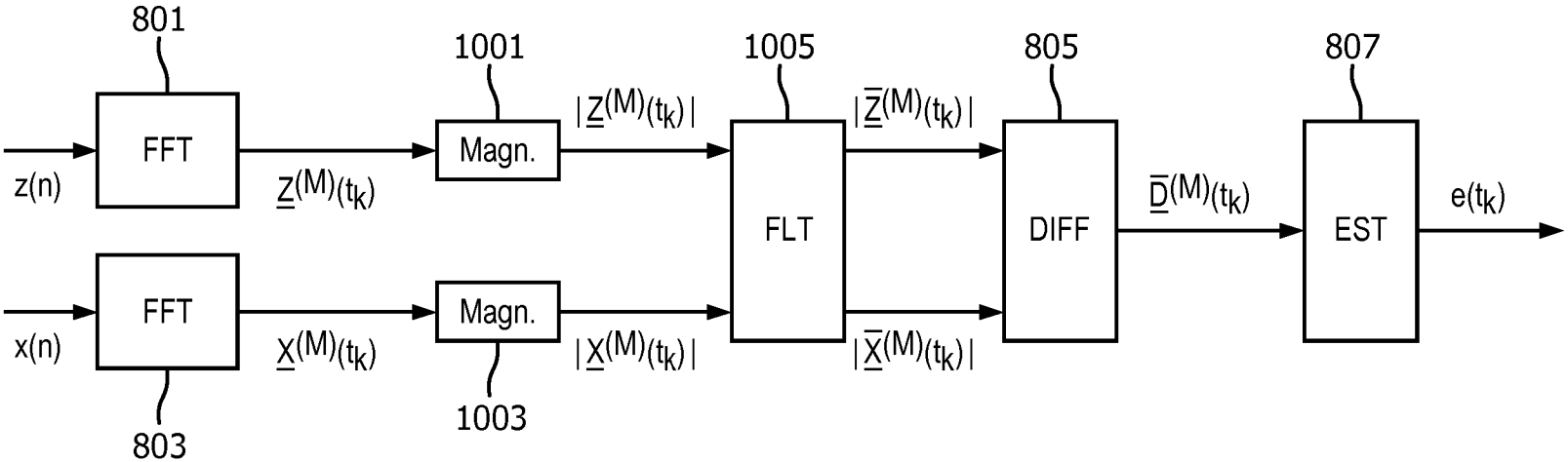
FIG. 10 illustrates an example of elements of a speech attack estimator for an audio capturing apparatus in accordance with some embodiments of the invention.

An example of a detector 307 based on the described considerations is provided in FIG. 10. In the example, the beamformed audio output signal and the noise reference signal are provided to the first transformer 801 and the second transformer 803 which generate the corresponding first and second frequency domain signals.

The frequency domain signals are generated e.g. by computing a short-time Fourier transform (STFT) of e.g. overlapping Hanning windowed blocks of the time domain signal. The STFT is in general a function of both time and frequency, and is expressed by the two arguments $t_k$ and $\omega_l$ with $t_k=kB$ being the discrete time, and where k is the frame index, B the frame shift, and $\omega_l=l\omega_0$ is the (discrete) frequency, with/being the frequency index and $\omega_0$ denoting the elementary frequency spacing.

After this frequency domain transformation the frequency domain signals represented by vectors $Z^{(M)}(t_k)$ and $X^{(M)}(t_k)$ respectively of length are thus provided.

The frequency domain transformation is in the specific example fed to magnitude units 1001, 1003 which determine and outputs the magnitudes of the two signals, i.e. they generate the values $$|Z^{(M)}(t_k)| \text{ and } |X^{(M)}(t_k)|.$$

In other embodiments, other norms may be used and the processing may include applying monotonic functions.

The magnitude units 1001, 1003 are coupled to a low pass filter 1005 which may smooth the magnitude values. The filtering/smoothing may be in the time domain, the frequency domain, or often advantageously both, i.e. the filtering may extend in both the time and frequency dimensions.

The filtered magnitude signals/vectors $\overline{|Z^{(M)}(t_k)|}$ and $\overline{|X^{(M)}(t_k)|}$ will also be referred to as $|^{(M)}(t_k)|$ and $|\underline{\check{X}}^{(M)}(t_k)|$.

The filter 1005 is coupled to the difference processor 805 which is arranged to determine the time frequency tile difference measures. As a specific example, the difference processor 805 may generate the time frequency tile difference measures as:

$$\bar{d}(t_k,\omega_l)=\overline{|Z(t_k,\omega_l)|}-\gamma_n\overline{|X(t_k,\omega_l)|}$$

The design parameter $\gamma_n$ may typically be in the range of 1 . . . 2.

The difference processor 805 is coupled to the speech attack estimator 807 which is fed the time frequency tile difference measures and which in response proceeds to determine the speech attack estimate by combining these.

Specifically, the sum of the time frequency tile difference measures $d(t_k,\omega_l)$ for frequency values between $\omega_l=\omega_{low}$ and $\omega_l=\omega_{high}$ may be determined as:

$$e(t_k)=\sum_{\omega_l=\omega_{low}}^{\omega_l=\omega_{high}}\bar{d}(t_k,\omega_l).$$

In some embodiments, this value may be output from the detector 307. In other embodiments, the determined value may be compared to a threshold and used to generate e.g. a binary value indicating whether speech attack is considered to be detected or not. Specifically, the value $e(t_k)$ may be compared to the threshold of zero, i.e. if the value is negative it is considered that speech attack has not been detected and if it is positive it is considered that speech attack has been detected in the beamformed audio output signal.

In the example, the detector 307 included low pass filtering/averaging for the magnitude time frequency tile values of the beamformed audio output signal and for the magnitude time frequency tile values of the noise reference signal.

The smoothing may specifically be performed by performing an averaging over neighboring values. For example, the following low pass filtering may be applied to the first frequency domain signal:

$$\overline{|Z(t_k,\omega_l)|}=\Sigma_{m=0}^{2}\Sigma_{n=-1}^{N}|Z(t_{k-m},\omega_{l-n})|*W(m,n),$$

where (with N=1) W is a 3*3 matrix with weights of ⅙. It will be appreciated that other values of N can of course be used, and similarly different time intervals can be used in other embodiments. Indeed, the size over which the filtering/smoothing is performed may be varied, e.g. in dependence on the frequency (e.g. a larger kernel is applied for higher frequencies than for lower frequencies).

Indeed, it will be appreciated that the filtering may be achieved by applying a kernel having a suitable extension in both the time direction (number of neighboring time frames considered) and in the frequency direction (number of neighboring frequency bins considered), and indeed that the size of thus kernel may be varied e.g. for different frequencies or for different signal properties.

Also, different kernels, as represented by W(m,n) in the above equation may be varied, and this may similarly be a dynamic variations, e.g. for different frequencies or in response to signal properties.

The filtering not only reduces late reverberation and noise and thus provides a more accurate estimation but it in particular increases the differentiation between (direct plus first reflections) speech and late reverberations and noise. Indeed, the filtering will have a substantially higher impact on late reverberation and noise than on the direct path and first reflections of a point audio source resulting in a larger difference being generated for the time frequency tile difference measures.

The correlation between the beamformed audio output signal and the noise reference signal(s) for beamformers such as that of FIG. 1 were found to reduce for increasing frequencies. Accordingly, the speech attack estimate is generated in response to only time frequency tile difference measures for frequencies above a threshold. This results in increased decorrelation and accordingly a larger difference between the beamformed audio output signal and the noise reference signal when speech is present. This results in a more accurate detection of point audio sources in the beamformed audio output signal.

In many embodiments, advantageous performance has been found by limiting the speech attack estimate to be based only on time frequency tile difference measures for frequencies not below 500 Hz, or in some embodiments advantageously not below 1 kHz or even 2 kHz.

However, in some applications or scenarios, a significant correlation between the beamformed audio output signal and the noise reference signal may remain for even relatively high audio frequencies, and indeed in some scenarios for the entire audio band.

Indeed, in an ideal spherically isotropic diffuse sound field, the beamformed audio output signal and the noise reference signal will be partially correlated, with the consequence that the expected values of $|Z_r(t_k,\omega_l)|$ and $|X_n(t_k,\omega_l)|$ will not be equal, and therefore $|Z_r(t_k,\omega_l)|$ cannot readily be replaced by $|X_n(t_k,\omega_l)|$.

This can be understood by looking at the characteristics of an ideal spherically isotropic diffuse sound field. When two microphones are placed in such a field at distance d apart and have microphone signals $U(t_k,\omega_l)$ and $U_2(t_k,\omega_l)$ respectively, we have:

$$E\{|U_1(t_k,\omega)|^2\}=E\{|U_2(t_k,\omega)|^2\}=2\sigma^2$$

and $$E\{U_1(t_k,\omega)\cdot U_2^*(t_k,\omega)\}=2\sigma^2\frac{\sin(kd)}{kd}=2\sigma^2\operatorname{sinc}(kd),$$

with the wave number $k=\omega/c$ (c is the velocity of sound) and $\sigma^2$ the variance of the real and imaginary parts of $U_1(t_k,\omega_l)$ and $U_2(t_k,\omega_l)$, which are Gaussian distributed.

Suppose the beamformer is a simple 2-microphone Delay-and-Sum beamformer and forms a broadside beam (i.e. the delays are zero).

We can write:

$$Z(t_k,\omega_l)=U_1(t_k,\omega_l)+U_2(t_k,\omega_l),$$

and for the noise reference signal:

$$X(t_k,\omega_l)=U_1(t_k,\omega_l)-U_2(t_k,\omega_l).$$

For the expected values we get, assuming only late reverberations and possibly noise are present:

$$E\{|Z(t_k,\omega)|^2\}=E\{|U_1(t_k,\omega)|^2\}+E\{|U_2(t_k,\omega)|^2\}+2\mathrm{Re}(E\{U_1(t_k,\omega)\cdot U_2^*(t_k,\omega)\}$$

$$=4\sigma^2+4\sigma^2\sin c(kd)$$

$$=4\sigma^2(1+\sin c(kd)).$$

Similarly we get for $E\{|X(t_k,\omega)|^2\}$:

$$E\{|X(t_k,\omega)|^2\}=4\sigma^2(1-\sin c(kd)).$$

Thus for the low frequencies $|Z_r(t_k,\omega_l)|$ and $|X_n(t_k,\omega_l)|$ will not be equal.

In some embodiments, the detector 307 may be arranged to compensate for such correlation. In particular, the detector 307 may be arranged to determine a noise coherence estimate $C(t_k,\omega_l)$ which is indicative of a correlation between the amplitude of the noise reference signal and the amplitude of a noise component of the beamformed audio output signal. The determination of the time frequency tile difference measures may then be as a function of this coherence estimate.

Indeed, in many embodiments, the detector 307 may be arranged to determine a coherence for the beamformed audio output signal and the noise reference signal from the beamformer based on the ratio between the expected amplitudes:

$$C(t_k,\omega_l)=\frac{E\{|Z_r(t_k,\omega_l)|\}}{E\{|X_n(t_k,\omega_l)|\}},$$

where $E\{.\}$ is the expectation operator. The coherence term is an indication of the average correlation between the amplitudes of the noise component in the beamformed audio output signal and the amplitudes of the reference noise reference signal.

Since $C(t_k,\omega_l)$ is not dependent on the instantaneous audio at the microphones but instead depends on the spatial characteristics of the noise sound field, the variation of $C(t_k,\omega_l)$ as a function of time is much less than the time variations of $Z_r$ and $X_n$.

As a result $C(t_k,\omega_l)$ can be estimated relatively accurately by averaging $|Z_r(t_k,\omega_l)|$ and $|X_n(t_k,\omega_l)|$ over time during the periods where no direct speech and first reflections are present. An approach for doing so is disclosed in U.S. Pat. No. 7,602,926, which specifically describes a method where no explicit speech detection is needed for determining $C(t_k,\omega_l)$.

It will be appreciated that any suitable approach for determining the noise coherence estimate $C(t_k,\omega_l)$ may be used. For example, for each time frequency tile where $e(t_k)$ does not exceed a certain threshold, indicating that no direct speech and early reflections are available/dominant, the first and second frequency domain signal can be compared and the noise correlation estimate $C(t_k,\omega_l)$ can simply be determined as the average ratio of the time frequency tile values of the first frequency domain signal and the second frequency domain signal.

For an ideal spherically isotropic diffuse noise field the coherence function can also be analytically be determined following the approach described above.

Based on this estimate $|Z_r(t_k,\omega_l)|$ can be replaced by $C(t_k,\omega_l)|X_n(t_k,\omega_l)|$ rather than just $|X_n(t_k,\omega_l)|$. This may result in time frequency tile difference measures given by:

$$\overline{d}=\overline{|Z(t_k,\omega_l)|}-\gamma\overline{C(t_k,\omega_l)|X(t_k,\omega_l)|}.$$

Thus, the previous time frequency tile difference measure can be considered a specific example of the above difference measure with the coherence function set to a constant value of 1.

The use of the coherence function may allow the approach to be used at lower frequencies, including at frequencies where there is a relatively strong correlation between the beamformed audio output signal and the noise reference signal.

It will be appreciated that the approach may further advantageously in many embodiments further include an adaptive canceller which is arranged to cancel a signal component of the beamformed audio output signal which is correlated with the at least one noise reference signal. For example, similarly to the example of FIG. 1, an adaptive filter may have the noise reference signal as an input and with the output being subtracted from the beamformed audio output signal. The adaptive filter may e.g. be arranged to minimize the level of the resulting signal during time intervals where no speech is present.

Thus, the insight that during an attack of speech the beamformed audio output signal from a beamformer will be large when compared to the noise references and that the noise references will (relative to the output signal) increase when later and potentially dominant reflections are received (and that even later on the reflections can be modeled as coming from a diffuse soundfield) has led to the development of a specific speech attack estimate. Indeed, the generated measure $e(t_k)$ provides an excellent indication of whether the direct field and first reflections dominate the microphone signals ($e(t_k)$ positive) or whether the remaining late reflections and/or diffuse echoes dominate the microphone signals ($e(t_k)$ negative). It also allows the beamformer to be adapted during frequent intervals during a typical speech segment. Indeed, it is not limited to only adapt at the very beginning of a speech segment after a pause but allows the adaptation to occur whenever an attack occurs during the speech segment.

It will be appreciated that many different approaches for adapting a beamformer and for determining suitable update values for beamform filters are known, and that any suitable approach may be used by the adapter of FIG. 3 (or 11).

It will also be appreciated that different adaptation step sizes, and thus different adaptation rates or bandwidths can be used. Indeed, in many embodiments, the adaptation step size may advantageously be made adaptive and may be dynamically varied.

Indeed, it has been found that in many embodiments, it may be advantageous for the adaptation rate (which for a constant frequency of updates may correspond to the size, magnitude, or scaling of the changes to the beamform parameters) to be adapted individually for individual time frequency tiles. Indeed, the Inventors have realized that it is particularly advantageous to adapt the adaptation rate for a given time frequency tile in response to the time frequency tile difference for that tile. Specifically, the adaptation rate or size may be scaled by a factor which is dependent on the difference measure for that time frequency tile. An effect of such an approach is that it will typically make the adaptation frequency dependent.

As a specific example, an adaptation step size may be multiplied by a frequency dependent gain function, that varies between 0 and 1 and which is dependent on the difference measure for the individual time frequency tile. A possible gain function is specifically:

$$G(t_k,\omega_l)=\mathrm{MAX}\left\{0,\ \frac{\overline{|Z(t_k,\omega_l)|}-\gamma\overline{C(t_k,\omega_l)|X(t_k,\omega_l)|}}{\overline{|Z(t_k,\omega_l)|}}\right\}.$$

This gain factor has the feature that for the situation where $\gamma\overline{C(t_k,\omega_l)|X(t_k,\omega_l)|}$ is small compared to $\overline{|Z(t_k,\omega_l)|}$, $G(t_k,\omega_l)$ will be approximately one. For the situation where $\gamma\overline{C(t_k,\omega_l)|X(t_k,\omega_l)|}$ is larger than $|Z(t_k,\omega_l)|$, $G(t_k,\omega_l)$ will be zero. Thus, the adaptation is frequency dependently adapted to reflect the indication of speech attack resulting from the comparison of the energy level of the beamformed audio output signal and the noise reference signal.

It will be appreciated that the duration of the adaptation time interval may be different in different embodiments. For example, in some embodiments, the adaptation time interval may start when the attack of speech is detected and may continue for a fixed period of time. In such cases, it may be desirable for the adaptation duration to be sufficiently long to include the entire buildup of speech yet preferably to not include adaption when strong later reflections become dominant.

In many embodiments, it is desirable for the adaptation time interval not be too long, and indeed it has been found that improved performance is often found for durations below 100 msec.

The approach may be further illustrated by an (artificial) example. Firstly, if it is considered that the speech signal consists of a single Dirac pulse, then the signals received at the microphones is the room impulse response. If it is assumed that the beamform filter can model the first, say, 16 msec (i.e. the beamform filter impulse response length is 16 msec), then after the first sound reaches the microphones only the first 16 msec of the sound is useful as only this can be modelled by the filter. It would therefore be desirable to stop the adaptation after 16 msec.

However, if it instead is assumed that the speech signal consists of 3 subsequent Dirac pulses, each separated by 16 msec, but with amplitudes of, say, 1, 1000, 1000000 (i.e. increasing by large amounts), then during the first 16 msec after the arrival of the first sound (corresponding typically to the direct path of the first Dirac pulse) all the received sound is useful and worth adapting to. After 16 msec undesired sound from the first pulse is received, i.e. late reflections that cannot be modelled are received from the first Dirac pulse. However, in addition, useful and relevant sound is received from the second Dirac pulse (i.e. this can still be modelled by the beamform filters as it is within the first 16 msecs of the room response that can be modelled). Further, this sound from the second Dirac pulse is much stronger and thus more useful than the remaining sound from the first Dirac pulse. It is thus still desirable to adapt the beamformer 303. This repeats itself for the third Dirac pulse, i.e. after 32 msec late reflections that cannot be modelled are received from the first and second Dirac pulse but at the same time whereas strong signals that can be modelled are being received from the third Dirac pulse. Thus, in this scenario, it would be desirable to stop adaptation after 48 msec.

Thus, in this situation where effectively three different speech attacks occur (illustrated by the artificial Dirac pulses), an adaptation time interval may be started at each detection of a speech attack. Indeed, before each adaptation time interval is terminated, a new speech attack is detected and the adaptation time interval is extended to reflect that the late reflections from the previous speech are dominated by the early reflections for the new attack (due to the higher signal level resulting from the attack).

In some embodiments, an adaptation time interval may be arranged to have a duration between 50% and 200% of the duration of the impulse responses. In many embodiments, the adaptation time interval may be arranged to have a duration not exceeding the duration of the impulse responses. In particular, in some embodiments, such durations may be set to be predetermined. For example, in the above specific scenarios, the impulse responses may have a duration of 16 msec and the duration of the adaptation time interval may be set to be 16 msec. This will in the example result in three consecutive adaptation time intervals of 16 msec, resulting in the desired overall adaptation duration of 48 msec.

In many embodiments, the controller 309 may be arranged to determine an end time of the adaptation time interval in response to a comparison of a signal level of the beamformed audio output signal relative to a signal level of the at least one noise reference signal. For example, if the ratio or difference of the signal power of the beamformed audio output signal relative to the signal power of the noise reference signal falls below a given level, this may as previously described indicate that late reflections that cannot be modelled are becoming dominant. Accordingly, the controller may terminate the adaptation. Thus, in some embodiments, the controller 309 may be arranged to terminate the adaptation time interval prior to the predetermined maximum duration if it is detected that a specific condition occurs. This condition may specifically be determined by the comparison of the signal level of the beamformed audio output signal relative to the signal level of the at least one noise reference signal.

As a specific example, the controller 309 may continuously monitor the value $e(t_k)$ derived above and if this falls below a given threshold (typically zero) the adaptation may be terminated.

Thus, indeed a system may be provided wherein the controller continuously monitors the speech attack estimate, such as specifically $e(t_k)$ as this varies due to the non-stationarity of speech. If the speech attack estimate increases above a threshold, the controller 309 may start adaptation and when it falls below a threshold it may stop the adaptation. In this way, the system may automatically controls the adaptation of the beamformer 303 to only occur during times when the direct path and early reflections that can be modelled dominate late reflections and reverberation that cannot be modelled.

In the following an audio capturing apparatus will be described in which the speech attack detector 307 interworks with the other described elements to provide a particularly advantageous audio capturing system. In particular, the approach is highly suitable for capturing audio sources in noisy and reverberant environments. It provides particularly advantageous performance for applications wherein a desired audio source may be outside the reverberation radius and the audio captured by the microphones may be dominated by diffuse noise and late reflections or reverberations.

Figure 11:
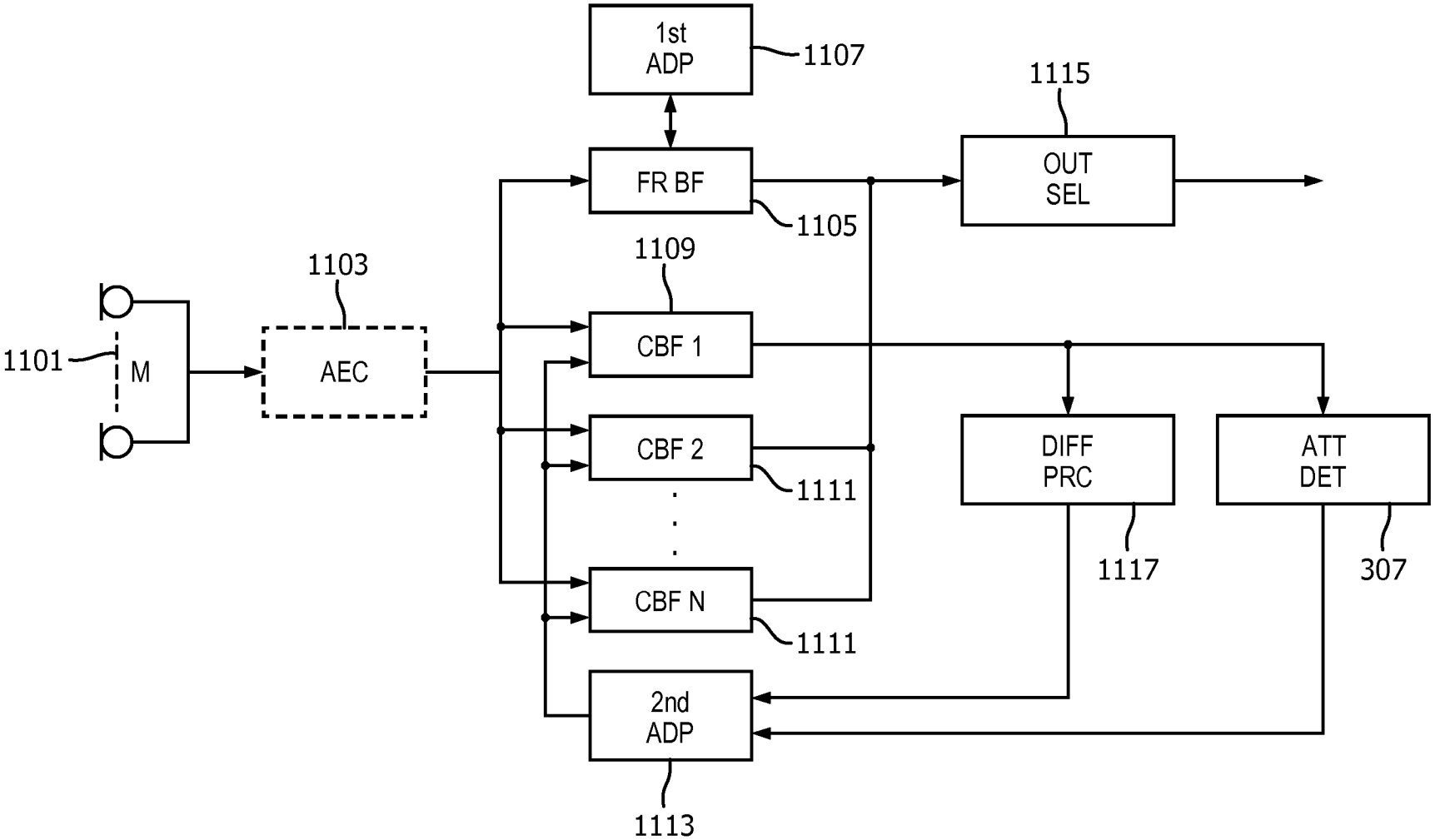
FIG. 11 illustrates an example of elements of an audio capturing apparatus in accordance with some embodiments of the invention.

FIG. 11 illustrates an example of elements of such an audio capturing apparatus in accordance with some embodiments of the invention. The elements and approach of the system of FIG. 3 may correspond to the system of FIG. 11 as set out in the following.

The audio capturing apparatus comprises a microphone array 1101 which may directly correspond to the microphone array 301 of FIG. 3. In the example, the microphone array 1101 is coupled to an optional echo canceller 1103 which may cancel the echoes that originate from acoustic sources (for which a reference signal is available) that are linearly related to the echoes in the microphone signal(s). This source can for example be a loudspeaker. An adaptive filter can be applied with the reference signal as input, and with the output being subtracted from the microphone signal to create an echo compensated signal. This can be repeated for each individual microphone.

It will be appreciated that the echo canceller 1103 is optional and simply may be omitted in many embodiments.

The microphone array 1101 is coupled to a first beamformer 1105, typically either directly or via the echo canceller 1103 (as well as possibly via amplifiers, digital to analog converters etc. as will be well known to the person skilled in the art). The first beamformer 1105 may directly correspond to the beamformer 303 of FIG. 3.

The first beamformer 1105 is arranged to combine the signals from the microphone array 1101 such that an effective directional audio sensitivity of the microphone array 1101 is generated. The first beamformer 1105 thus generates an output signal, referred to as the first beamformed audio output, which corresponds to a selective capturing of audio in the environment. The first beamformer 1105 is an adaptive beamformer and the directivity can be controlled by setting parameters, referred to as first beamform parameters, of the beamform operation of the first beamformer 1105.

The first beamformer 1105 is coupled to a first adapter 1107 which is arranged to adapt the first beamform parameters. Thus, the first adapter 1107 is arranged to adapt the parameters of the first beamformer 1105 such that the beam can be steered.

In addition, the audio capturing apparatus comprises a plurality of constrained beamformers 1109, 1111 each of which is arranged to combine the signals from the microphone array 1101 such that an effective directional audio sensitivity of the microphone array 1101 is generated. Each of the constrained beamformers 1109, 1111 is thus arranged to generate an audio output, referred to as the constrained beamformed audio output, which corresponds to a selective capturing of audio in the environment. Similarly, to the first beamformer 1105, the constrained beamformers 1109, 1111 are adaptive beamformers where the directivity of each constrained beamformer 1109, 1111 can be controlled by setting parameters, referred to as constrained beamform parameters, of the constrained beamformers 1109, 1111.

The audio capturing apparatus accordingly comprises a second adapter 1113 which is arranged to adapt the constrained beamform parameters of the plurality of constrained beamformers thereby adapting the beams formed by these.

The beamformer 303 of FIG. 3 may directly correspond to the first constrained beamformer 1109 of FIG. 11. It will also be appreciated that the remaining constrained beamformers 1111 may correspond to the first beamformer 1109 and could be considered instantiations of this.

Both the first beamformer 1105 and the constrained beamformers 1109, 1111 are accordingly adaptive beamformers for which the actual beam formed can be dynamically adapted. Specifically, the beamformers 1105, 1109, 1111 are filter-and-combine (or specifically in most embodiments filter-and-sum) beamformers. A beamform filter may be applied to each of the microphone signals and the filtered outputs may be combined, typically by simply being added together.

It will be appreciated that the beamformer 303 of FIG. 3 may correspond to any of the beamformers 1105, 1109, 1111 and that indeed the comments provided with respect to the beamformer 303 of FIG. 3 apply equally to any of the first beamformer 1105 and the constrained beamformers 1109, 1111 of FIG. 11.

Similarly, the second adapter 513 may correspond directly to the adapter 305 of FIG. 3.

In many embodiments, the structure and implementation of the first beamformer 1105 and the constrained beamformers 1109, 1111 may be the same, e.g. the beamform filters may have identical FIR filter structures with the same number of coefficients etc.

However, the operation and parameters of the first beamformer 1105 and the constrained beamformers 1109, 1111 will be different, and in particular the constrained beamformers 1109, 1111 are constrained in ways the first beamformer 1105 is not. Specifically, the adaptation of the constrained beamformers 1109, 1111 will be different than the adaptation of the first beamformer 1105 and will specifically be subject to some constraints.

Specifically, the constrained beamformers 1109, 1111 are subject to the constraint that the adaptation (updating of beamform filter parameters) is constrained to situations when a criterion is met whereas the first beamformer 1105 will be allowed to adapt even when such a criterion is not met. Indeed, in many embodiments, the first adapter 1107 may be allowed to always adapt the beamform filter with this not being constrained by any properties of the audio captured by the first beamformer 1105 (or of any of the constrained beamformers 1109, 1111). Further, the second adapter 1113 is arranged to only adapt during adaptation time intervals determined in response to detections of speech attack.

The criterion for adapting the constrained beamformers 1109, 1111 will be described in more detail later.

In many embodiments, the adaptation rate for the first beamformer 1105 is higher than for the constrained beamformers 1109, 1111. Thus, in many embodiments, the first adapter 1107 may be arranged to adapt faster to variations than the second adapter 1113, and thus the first beamformer 1105 may be updated faster than the constrained beamformers 1109, 1111. This may for example be achieved by the low pass filtering of a value being maximized or minimized (e.g. the signal level of the output signal or the magnitude of an error signal) having a higher cut-off frequency for the first beamformer 1105 than for the constrained beamformers 1109, 1111. As another example, a maximum change per update of the beamform parameters (specifically the beamform filter coefficients) may be higher for the first beamformer 1105 than for the constrained beamformers 1109, 1111.

Accordingly, in the system, a plurality of focused (adaptation constrained) beamformers that adapt slowly and only when a specific criterion is met is supplemented by a free running faster adapting beamformer that is not subject to this constraint. The slower and focused beamformers will typically provide a slower but more accurate and reliable adaptation to the specific audio environment than the free running beamformer which however will typically be able to quickly adapt over a larger parameter interval.

In the system of FIG. 11, these beamformers are used synergistically together to provide improved performance as will be described in more detail later.

The first beamformer 1105 and the constrained beamformers 1109, 1111 are coupled to an output processor 1115 which receives the beamformed audio output signals from the beamformers 1105, 1109, 1111. The exact output generated from the audio capturing apparatus will depend on the specific preferences and requirements of the individual embodiment. Indeed, in some embodiments, the output from the audio capturing apparatus may simply consist in the audio output signals from the beamformers 1105, 1109, 1111.

In many embodiments, the output signal from the output processor 1115 is generated as a combination of the audio output signals from the beamformers 1105, 1109, 1111. Indeed, in some embodiments, a simple selection combining may be performed, e.g. selecting the audio output signals for which the signal to noise ratio, or simply the signal level, is the highest.

Thus, the output selection and post-processing of the output processor 1115 may be application specific and/or different in different implementations/embodiments. For example, all possible focused beam outputs can be provided, a selection can be made based on a criterion defined by the user (e.g. the strongest speaker is selected), etc.

For a voice control application, for example, all outputs may be forwarded to a voice trigger recognizer which is arranged to detect a specific word or phrase to initialize voice control. In such an example, the audio output signal in which the trigger word or phrase is detected may following the trigger phrase be used by a voice recognizer to detect specific commands.

For communication applications, it may for example be advantageous to select the audio output signal that is strongest and e.g. for which the presence of a specific point audio source has been found.

In some embodiments, post-processing such as the noise suppression of FIG. 1, may be applied to the output of the audio capturing apparatus (e.g. by the output processor 1115). This may improve performance for e.g. voice communication. In such post-processing, non-linear operations may be included although it may e.g. for some speech recognizers be more advantageous to limit the processing to only include linear processing.

In the system of FIG. 11, a particularly advantageous approach is taken to capture audio based on the synergistic interworking and interrelation between the first beamformer 1105 and the constrained beamformers 1109, 1111.

For this purpose, the audio capturing apparatus comprises a beam difference processor 1117 which is arranged to determine a difference measure between one or more of the constrained beamformers 1109, 1111 and the first beamformer 1105. The difference measure is indicative of a difference between the beams formed by respectively the first beamformer 1105 and the constrained beamformer 1109, 1111. Thus, the difference measure for a first constrained beamformer 1109 may indicate the difference between the beams that are formed by the first beamformer 1105 and by the first constrained beamformer 1109. In this way, the difference measure may be indicative of how closely the two beamformers 1105, 1109 are adapted to the same audio source.

Different difference measures may be used in different embodiments and applications.

In some embodiments, the difference measure may be determined based on the generated beamformed audio output from the different beamformers 1105, 1109, 1111. As an example, a simple difference measure may simply be generated by measuring the signal levels of the output of the first beamformer 1105 and the first constrained beamformer 1109 and comparing these to each other. The closer the signal levels are to each other, the lower is the difference measure (typically the difference measure will also increase as a function of the actual signal level of e.g. the first beamformer 1105).

A more suitable difference measure may in many embodiments be generated by determining a correlation between the beamformed audio output from the first beamformer 1105 and the first constrained beamformer 1109. The higher the correlation value, the lower the difference measure.

Alternatively or additionally, the difference measure may be determined on the basis of a comparison of the beamform parameters of the first beamformer 1105 and the first constrained beamformer 1109. For example, the coefficients of the beamform filter of the first beamformer 1105 and the beamform filter of the first constrained beamformer 1109 for a given microphone may be represented by two vectors. The magnitude of the difference vector of these two vectors may then be calculated. The process may be repeated for all microphones and the combined or average magnitude may be determined and used as a distance measure. Thus, the generated difference measure reflects how different the coefficients of the beamform filters are for the first beamformer 1105 and the first constrained beamformer 1109, and this is used as a difference measure for the beams.

Thus, in the system of FIG. 11, a difference measure is generated to reflect a difference between the beamform parameters of the first beamformer 1105 and the first constrained beamformer 1109 and/or a difference between the beamformed audio outputs of these.

It will be appreciated that generating, determining, and/or using a difference measure is directly equivalent to generating, determining, and/or using a similarity measure. Indeed, one may typically be considered to be a monotonically decreasing function of the other, and thus a difference measure is also a similarity measure (and vice versa) with typically one simply indicating increasing differences by increasing values and the other doing this by decreasing values.

The beam difference processor 1117 is coupled to the second adapter 1113 and provides the difference measure to this. The second adapter 1113 is arranged to adapt the constrained beamformers 1109, 1111 in response to the difference measure. Specifically, the second adapter 1113 is arranged to adapt constrained beamform parameters only for constrained beamformers for which a difference measure has been determined that meets a similarity criterion. Thus, if no difference measure has been determined for a given constrained beamformers 1109, 1111, or if the determined difference measure for the given constrained beamformer 1109, 1111 indicates that the beams of the first beamformer 1105 and the given constrained beamformer 1109, 1111 are not sufficiently similar, then no adaptation is performed.

Thus, in the audio capturing apparatus of FIG. 11, the constrained beamformers 1109, 1111 are constrained in the adaptation of the beams. Specifically, they are constrained to only adapt if the current beam formed by the constrained beamformer 1109, 1111 is close to the beam that the free running first beamformer 1105 is forming, i.e. the individual constrained beamformer 1109, 1111 is only adapted if the first beamformer 1105 is currently adapted to be sufficiently close to the individual constrained beamformer 1109, 1111.

The result of this is that the adaptation of the constrained beamformers 1109, 1111 are controlled by the operation of the first beamformer 1105 such that effectively the beam formed by the first beamformer 1105 controls which of the constrained beamformers 1109, 1111 is (are) optimized/adapted. This approach may specifically result in the constrained beamformers 1109, 1111 tending to be adapted only when a desired audio source is close to the current adaptation of the constrained beamformer 1109, 1111.

The approach of requiring similarity between the beams in order to allow adaptation has in practice been found to result in a substantially improved performance when the desired audio source, the desired speaker in the present case, is outside the reverberation radius. Indeed, it has been found to provide highly desirable performance for, in particular, weak audio sources in reverberant environments with a non-dominant direct path audio component.

In many embodiments, the constraint of the adaptation may be subject to further requirements.

For example, in many embodiments, the adaptation may be a requirement that a signal to noise ratio for the beamformed audio output exceeds a threshold. Thus, the adaptation for the individual constrained beamformer 1109, 1111 may be restricted to scenarios wherein this is sufficiently adapted and the signal on basis of which the adaptation is based reflects the desired audio signal.

It will be appreciated that different approaches for determining the signal to noise ratio may be used in different embodiments. For example, the noise floor of the microphone signals can be determined by tracking the minimum of a smoothed power estimate and for each frame or time interval the instantaneous power is compared with this minimum. As another example, the noise floor of the output of the beamformer may be determined and compared to the instantaneous output power of the beamformed output.

In some embodiments, the adaptation of a constrained beamformer 1109, 1111 is restricted to when a speech component has been detected in the output of the constrained beamformer 1109, 1111. This will provide improved performance for speech capture applications. It will be appreciated that any suitable algorithm or approach for detecting speech in an audio signal may be used. In particular, the previously described approach of the detector 307 may be applied.

It will be appreciated that the systems of FIGS. 3 and 11 typically operate using a frame or block processing. Thus, consecutive time intervals or frames are defined and the described processing may be performed within each time interval. For example, the microphone signals may be divided into processing time intervals, and for each processing time interval the beamformers 1105, 1109, 1111 may generate a beamformed audio output signal for the time interval, determine a difference measure, select a constrained beamformers 1109, 1111, and update/adapt this constrained beamformer 1109, 1111 etc. Processing time intervals may in many embodiments advantageously have a duration between 11 msec and 110 msec.

It will be appreciated that in some embodiments, different processing time intervals may be used for different aspects and functions of the audio capturing apparatus. For example, the difference measure and selection of a constrained beamformer 1109, 1111 for adaptation may be performed at a lower frequency than e.g. the processing time interval for beamforming.

In the system, the adaptation is further in dependence on the detection of speech attack in the beamformed audio outputs. Accordingly, the audio capturing apparatus may further comprise the detector 307 already described with respect to FIG. 3

The detector 307 may specifically in many embodiments be arranged to detect speech attack in each of the constrained beamformers 1109, 1111 and accordingly the detector 307 is coupled to these and receives the beamformed audio output signals. In addition, it receives the noise reference signals from the constrained beamformers 1109, 1111 (for clarity FIG. 11 illustrates the beamformed audio output signal and the noise reference signal by single lines, i.e. the lines of FIG. 11 may be considered to represent a bus comprising both the beamformed audio output signal and the noise reference signal(s), as well as e.g. beamform parameters).

Thus, the operation of the system of FIG. 11 is dependent on the speech attack estimation performed by the detector 307 in accordance with the previously described principles. The detector 307 may specifically be arranged to generate a speech attack estimate for all the beamformers 1105, 1109, 1111.

The detection result is passed from the detector 307 to the second adapter 1113 which is arranged to adapt the adaptation in response to this. Specifically, the second adapter 1113 may be arranged to adapt only constrained beamformers 1109, 1111 for which the detector 307 indicates that a speech attack has been detected. Specifically, the controller 309 of FIG. 3 may be included in the second adapter 1113 which accordingly may be arranged to constrain the adaptation of the constrained beamformers 1109, 1111 to only occur in (short) adaptation time intervals following detections of speech attack.

Thus, the audio capturing apparatus is arranged to constrain the adaptation of the constrained beamformers 1109, 1111 such that only constrained beamformers 1109, 1111 are adapted in which a speech attack is occurring, and the formed beam is close to that formed by the first beamformer 1105. Thus, the adaptation is typically restricted to constrained beamformers 1109, 1111 which are already close to a (desired) point audio source. The approach allows for a very robust and accurate beamforming that performs exceedingly well in environments where the desired audio source may be outside a reverberation radius. Further, by operating and selectively updating a plurality of constrained beamformers 1109, 1111, this robustness and accuracy may be supplemented by a relatively fast reaction time allowing quick adaptation of the system as a whole to fast moving or newly occurring sound sources.

In many embodiments, the audio capturing apparatus may be arranged to only adapt one constrained beamformer 1109, 1111 at a time. Thus, the second adapter 1113 may in each adaptation time interval select one of the constrained beamformers 1109, 1111 and adapt only this by updating the beamform parameters. In scenarios wherein speech attack has been detected for a plurality of the constrained beamformers 1109, 1111, the constrained beamformer 1109, 1111 having the lowest difference measure may be selected.

In some embodiments, the adaptation may not be dependent on the beam difference measure and indeed it may be that no such measure is determined. Indeed, in some embodiments, the adaptation may only be based on the speech attack estimate.

For example, in some embodiments, the second adapter 1113 may be arranged to allow adaptation for all constrained beamformers 1109, 1111 for which speech attack has been detected. In some embodiments, the second adapter 1113 may be arranged to allow adaptation for only the constrained beamformers 1109, 1111 for which the strongest indication of speech attack has been detected.

In other embodiments, the second adapter 1113 may be arranged to simply select the constrained beamformer 1109, 1111 providing the strongest indication of speech attack even if this is indicative of no current speech attack.

As a specific example, the second adapter 1113 may execute the following operation expressed in pseudocode:

```
determine the beamformer 1 for which e_l(t_k) is largest
if
  e_l(t_k)>0
  then allowtoadapt=true
  else
    if e_l(t_k)>average(e_i(t_k))/a_thr ∀i, i≠l
      then allowtoadapt=true
      else allowtoadapt=false
end
  if allowtoadapt==true
  then adapt constrained beamformer k
end
```

Thus, in some embodiments, the audio capture apparatus may be arranged to adapt a given constrained beamformer if the speech attack estimate is indicative of a current speech attack or if the speech attack estimate is stronger for this beamformer than for any other constrained beamformer 1109, 1111, with a suitable margin If this latter condition is met, it indicates that direct speech is present in beamformer 1, but that the beamformer is not accurately focused yet.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc. do not preclude a plurality. Reference signs in the claims are provided merely as a clarifying example shall not be construed as limiting the scope of the claims in any way.

The invention claimed is:

1. An audio capture apparatus comprising:

a first beamformer, wherein the first beamformer is arranged to generate a beamformed audio output signal;

an adapter circuit, wherein the adapter circuit is arranged to adapt beamform parameters of the first beamformer;

a detector circuit, wherein the detector circuit is arranged to detect an attack of speech in the beamformed audio output signal; and a controller circuit, wherein the controller circuit is arranged to control the adaptation of the beamform parameters to occur in a predetermined adaptation time interval determined in response to the detection of the attack of speech.

2. The audio capturing apparatus of claim wherein the detector is arranged to detect the attack of speech in response to a signal level of received early reflections relative to a signal level of received late reflections.

3. The audio capturing apparatus of claim 1, wherein the first beamformer is arranged to generate at least one noise reference signal, wherein the detector is arranged to detect the attack of speech in response to a comparison of a signal level of the beamformed audio output signal relative to a signal level of the at least one noise reference signal.

4. The audio capturing apparatus of claim 3 wherein the controller circuit is arranged to terminate the predetermined adaptation time interval in response to a comparison of a signal level of the beamformed audio output signal relative to a signal level of the at least one noise reference signal.

5. The audio capturing apparatus of claim 1, wherein the first beamformer is arranged to generate at least one noise reference signal, wherein the detector comprises:

a first transformer, wherein the first transformer is arranged to generate a first frequency domain signal from a frequency transform of the beamformed audio output signal, wherein the first frequency domain signal is represented by time frequency tile values;

a second transformer, wherein the second transformer is arranged to generate a second frequency domain signal from a frequency transform of the at least one noise reference signal, wherein the second frequency domain signal is represented by time frequency tile values;

a difference processor circuit, wherein the difference processor circuit arranged to generate a time frequency tile difference measure, wherein the time frequency tile difference measure is indicative of a difference between a first monotonic function of a norm of a time frequency tile value of the first frequency domain signal and a second monotonic function of a norm of a time frequency tile value of the second frequency domain signal;

a speech attack estimator, wherein the speech attack estimator is arranged to generate a speech attack estimate in response to a combined difference value for time frequency tile difference measures for frequencies above a frequency threshold.

6. The audio capturing apparatus of claim 5 wherein the detector is arranged to determine a start time for the predetermined adaptation time interval in response to the combined difference value increasing above a threshold.

7. The audio capturing apparatus of claim 5, wherein the detector is arranged to terminate the predetermined adaptation time interval in response to the combined difference value falling below a threshold.

8. The audio capturing apparatus of claim 5, wherein the detector is arranged to generate a noise coherence estimate indicative of a correlation between an amplitude of the beamformed audio output signal and an amplitude of the at least one noise reference signal, wherein at least one of the first monotonic function and the second monotonic function is dependent on the noise coherence estimate.

9. The audio capturing apparatus of claim 5, wherein the adapter circuit is arranged to modify an adaptation rate for beamform parameters for a first time frequency tile in response to a time frequency tile difference measure for the first time frequency tile.

10. The audio capturing apparatus of claim 5, wherein the detector is arranged to filter at least one of the norms of the time frequency tile values of the first frequency domain signal and the norm of the time frequency tile values of the second frequency domain signal, wherein the filtering including time frequency tiles differing in both time and frequency.

11. The audio capturing apparatus of claim 1, wherein a duration from the attack of speech to an end of the predetermined adaptation time interval does not exceed 100 msec.

12. The audio capturing apparatus of claim 1 further comprising:

a plurality of beamformers, wherein the plurality of beamformers comprises the first beamformer; and an adaptor circuit, wherein the adaptor circuit is arranged to adapt at least one of the plurality of beamformers in response to the speech attack estimates, wherein the detector is arranged to generate a speech attack estimate for each beamformer of the plurality of beamformers.

13. The audio capturing apparatus of claim 12, wherein the first beamformer is arranged to generate a beamformed audio output signal and at least one noise reference signal, wherein the plurality of beamformers comprises a plurality of constrained beamformers, wherein the plurality of constrained beamformers are coupled to the microphone array, wherein each of the plurality of constrained beamformers are arranged to generate a constrained beamformed audio output and at least one constrained noise reference signal, wherein the adapter circuit is arranged to adapt constrained beamform parameters for a first constrained beamformer subject to a criteria comprising at least one constraint from the group consisting of a speech attack estimate for the first constrained beamformer beamformer indicative of speech attack detected for the first constrained beamformer, and a speech attack estimate for the first constrained beamformer indicative of higher probability of speech attack than the speech attack estimate for any other constrained beamformer of the plurality of constrained beamformers.

14. The audio capturing apparatus of claim 13 further comprising a beam difference processor circuit, wherein the beam difference processor circuit is arranged to determine a difference measure for at least one of the plurality of constrained beamformers, wherein the difference measure is indicative of a difference between beams formed by the first beamformer and the at least one of the plurality of constrained beamformers, wherein the adapter circuit is arranged to adapt constrained beamform parameters with a constraint that constrained beamform parameters are adapted only for constrained beamformers of the plurality of constrained beamformers for which a difference measure has been determined that meets a similarity criterion.

15. A method of audio capture comprising:

generating a beamformed audio output signal, using a beamformer;

adapting beamform parameters of the beamformer;

detecting an attack of speech in the beamformed audio output signal; and controlling the adaptation of the beamform parameters to occur in a predetermined adaptation time interval determined in response to the detection of the attack of speech.

* * * * *